US009196403B2

(12) United States Patent
Maeda et al.

(10) Patent No.: US 9,196,403 B2
(45) **Date of Patent: *Nov. 24, 2015**

(54) POWDER FOR MAGNETIC MEMBER, POWDER COMPACT, AND MAGNETIC MEMBER

(75) Inventors: Toru Maeda, Itami (JP); Asako Watanabe, Itami (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 321 days.

This patent is subject to a terminal disclaimer.

(21) Appl. No.: 13/511,061

(22) PCT Filed: May 10, 2011

(86) PCT No.: PCT/JP2011/060744

§ 371 (c)(1),
(2), (4) Date: May 21, 2012

(87) PCT Pub. No.: WO2011/145477

PCT Pub. Date: Nov. 24, 2011

(65) Prior Publication Data

US 2012/0286191 A1 Nov. 15, 2012

(30) Foreign Application Priority Data

May 19, 2010 (JP) ..... 2010-115229
Jul. 1, 2010 (JP) ..... 2010-151463
Mar. 14, 2011 (JP) ..... 2011-055881

(51) Int. Cl.
*H01F 1/06* (2006.01)
*H01F 1/08* (2006.01)
(Continued)

(52) U.S. Cl.
CPC ..... *H01F 1/0552* (2013.01); *B22F 1/0062* (2013.01); *C22C 33/0278* (2013.01);
(Continued)

(58) Field of Classification Search
None
See application file for complete search history.

(56) References Cited

U.S. PATENT DOCUMENTS 3,684,499 A 8/1972 Hofer et al.
5,474,623 A 12/1995 Ma et al.
(Continued)

FOREIGN PATENT DOCUMENTS

CN 1100228 A 3/1995
CN 1230755 A 10/1999
(Continued)

OTHER PUBLICATIONS

Notification of Second Office Action for corresponding Chinese Application No. 201180004578.9 dated Apr. 8, 2014, 17 pages.
(Continued)

*Primary Examiner* — Ronak Patel
(74) *Attorney, Agent, or Firm* — Ditthavong & Steiner, P.C.

(57) ABSTRACT

The present invention provides a powder for a magnetic member being excellent in moldability and difficult to oxidize, a powder compact produced from the powder, and a magnetic member suitable for a raw material of a magnetic member such as a rare earth magnet. A powder for a magnetic member includes magnetic particles 1 which constitute the powder for a magnetic member and each of which is composed of less than 40% by volume of a hydrogen compound 3 of a rare earth element, and the balance composed of an iron-containing material 2 which contains iron and an iron-boron alloy containing iron and boron. The hydrogen compound 3 of a rare earth element is dispersed in a phase of the iron-containing material 2. An antioxidant layer 4 having a low-oxygen permeability coefficient is provided on the surface of each of the magnetic particles 1.

15 Claims, 3 Drawing Sheets

(51) Int. Cl.

| | |
|---|---|
| ***H01F 1/055*** | (2006.01) |
| ***H01F 1/057*** | (2006.01) |
| ***B22F 1/00*** | (2006.01) |
| ***C22C 33/02*** | (2006.01) |
| ***C22C 38/00*** | (2006.01) |

(52) U.S. Cl.

CPC ..... *C22C38/005* (2013.01); *H01F 1/0572* (2013.01); *H01F 1/061* (2013.01); *B22F 2998/10* (2013.01); *C22C 2202/02* (2013.01); *H01F 1/0578* (2013.01); *H01F 1/083* (2013.01)

(56) References Cited

U.S. PATENT DOCUMENTS

| | | | | |
|---|---|---|---|---|
| 2002/0059965 | A1* | 5/2002 | Honkura et al. ..... | 148/105 |
| 2008/0251159 | A1 | 10/2008 | Odaka et al. | |
| 2009/0047594 | A1 | 2/2009 | Hirakawa | |
| 2010/0279105 | A1* | 11/2010 | Pyun et al. ..... | 428/327 |

FOREIGN PATENT DOCUMENTS

| | | | |
|---|---|---|---|
| CN | 1293435 | A | 5/2001 |
| CN | 1842385 | A | 10/2006 |
| CN | 101615459 | A | 12/2009 |
| JP | 53-78096 | A | 7/1978 |
| JP | 03129702 | A | 6/1991 |
| JP | 10-106875 | A | 4/1998 |
| JP | 11-158588 | A | 6/1999 |
| JP | 2003-031432 | A | 1/2003 |
| JP | 2004-134552 | A | 4/2004 |
| JP | 4029714 | B2 | 1/2008 |
| JP | 2008-172037 | A | 7/2008 |
| JP | 2009-123968 | A | 6/2009 |
| JP | 2011-137218 | A | 7/2011 |
| KR | 20020033504 | A | 5/2002 |
| WO | 2005/105343 | A1 | 11/2005 |

OTHER PUBLICATIONS

Office Action for Corresponding Chinese Application No. 201180004578.9 dated Oct. 17, 2013.

Decision to Grant for the corresponding Korean Application No. 10-2012-7010195, dated Jan. 2, 2014, 2 pages.

International Search Report for PCT Application No. PCT/JP2011/060744 dated Aug. 9, 2011, pp. 1-2.

Chinese Office Action for related Chinese Application No. 201080055027.0, dated Sep. 3, 2013, 22 pages.

Yu et al., "Effect of HD and HDDR Process on Magnetic Properties of Fe-Based Rare Earth Compound," Metallic Functional Materials, No. 1, pp. 18-21, Feb. 28, 1997 (with English Language Abstract).

International Search Report for related PCT Application No. PCT/JP2010/071604, dated Mar. 8, 2011, 1 page.

Zhang et al., "Development and Characteristics of Nd—Fe—B Powder Preparation," Powder Metallurgy Technology, No. 6, pp. 465-469, Dec. 30, 2005 (with English Language Abstract).

Notification of Reasons for Rejection for related Japanese Application No. 2010-253753, dated Apr. 9, 2012, 4 pages (with partial English Translation).

International Search Report for International Application No. PCT/JP2011/059183, mailed Jul. 19, 2011, 1 page.

Chinese Office Action for related Chinese Application No. 201180003841.2, dated Aug. 15, 2013, 21 pages.

Notice of decision to grant a patent for related Korean Application No. 1020127005937, dated Nov. 20, 2013, 2 pages.

Japanese Office Action for related Japanese Application No. 2011036281, dated Apr. 9, 2012, with partial English language translation, 4 pages.

* cited by examiner

POWDER FOR MAGNETIC MEMBER, POWDER COMPACT, AND MAGNETIC MEMBER

TECHNICAL FIELD

The present invention relates to a magnetic member suitable for materials of rare-earth magnets such as rare-earth-iron-boron magnets, a powder for a magnetic member used as a raw material of the magnetic member, and a powder compact. In particular, the present invention relates to a powder for a magnetic member which is excellent in moldability and is difficult to oxidize.

BACKGROUND ART

Rare earth magnets are widely used as permanent magnets used for motors and power generators. Typical examples of the rare earth magnets include sintered magnets and bond magnets each of which is composed of a R—Fe—B-based alloy (R: a rare earth element, Fe: iron, B: boron), such as Nd (neodymium)—Fe—B.

Sintered magnets are each produced by compacting a powder composed of a R—Fe—B-based alloy and then sintering the molded product, and bond magnets are each produced by mixing an alloy powder composed of a R—Fe—B-based alloy with a binder resin and then compacting or injection-molding the resultant mixture. In particular, the powders used for the bond magnets are subjected to hydrogenation-disproportionation-desorption-recombination treatment (HDDR treatment, HD: hydrogenation and disproportionation, DR: desorption and recombination) in order to enhance coercive force.

Sintered magnets are excellent in magnet characteristics because of the high ratio of magnetic phase, but have a small degree of freedom of shape and are thus difficult to form into complicated shapes, for example, a cylindrical shape, a columnar shape, and a pot shape (cylindrical shape with a bottom). On the other hand, bond magnets have a high degree of freedom of shape but have magnet characteristics inferior to those of the sintered magnets. In response to this, Patent Literature 1 discloses that a fine alloy powder composed of a Nd—Fe—B-based alloy is compression-molded to form a green compact (powder compact), and the green compact is subjected to HDDR treatment to increase the degree of freedom of shape and produce a magnet having excellent magnet characteristics.

CITATION LIST

Patent Literature

PTL 1: JP2009-123968A
PTL 2: JP2004-134552A

SUMMARY OF INVENTION

Technical Problem

As described above, sintered magnets have a low degree of freedom of shape and require processing such as cutting for forming a complicated shape or a desired shape, thereby decreasing productivity. On the other hand, bond magnets have a magnetic phase ratio of about 80% by volume at most because of the presence of a binder resin and thus have difficulty in increasing the ratio of magnetic phase. Therefore, it is desired to develop a material for a magnetic member such as a rare earth magnet which can be easily produced with a high magnetic phase ratio and a complicated shape.

In order to form a rare earth magnet having a high magnetic phase ratio without sintering, for example, it is considered to form a powder compact having a high relative density as a raw material for the magnet. However, an alloy powder composed of an Nd—Fe—B-based alloy disclosed in Patent Literature 1 and a HDDR powder produced by HDDR treatment of the alloy powder contain constituent particles which have high rigidity and are thus hardly deformed. Therefore, in order to produce a powder compact having a high relative density, relatively high pressure is required for producing a powder compact with a high relative density by compacting. In particular, when the alloy powder is composed of coarse particles, higher pressure is required, degrading productivity. Therefore, it is demanded to develop a raw material which can be easily molded into a powder compact having a high relative density.

In addition, HDDR treatment of a green compact as described in Patent Literature 1 may cause breakage of the resultant porous body for a magnet due to expansion-contraction of the green compact during the treatment. Therefore, it is demanded to develop a raw material which can produce a magnetic body such as a rare earth magnet causing little breakage during production and having satisfactory strength and excellent magnet characteristics.

Further, the rare earth elements are easily oxidized, and thus it is very difficult to remove oxygen from oxides thereof. In addition, when oxides of rare earth elements which are produced during manufacture are present in a magnetic body such as a rare earth magnet, a decrease in magnetic phase ratio is caused. Therefore, it is demanded to develop a raw material which is little oxidized during manufacture of the magnetic body.

Accordingly, an object of the present invention is to provide a powder for a magnetic member which has excellent moldability, which can form a powder compact with a high relative density, and which is little oxidized.

Another object of the present invention is to provide a magnetic member suitable for a material of a rare earth magnet having excellent magnet characteristics, and a powder compact suitable as a raw material for the magnetic member.

Solution to Problem

In order to increase a ratio of magnetic phase and to produce a magnetic member suitable for a raw material of a magnetic body such as a rare earth magnet without sintering, the inventors researched the use of powder molding, not molding for forming a bond magnet using a binder resin. As described above, usual raw material powders, i.e., an alloy powder composed of a Nd—Fe—B-based alloy and a HDDR powder, are hard and little deformable and thus have low moldability by compacting and difficulty in improving the density of a powder compact. Therefore, as a result of various researches for enhancing moldability, the inventors found that when a powder does not have a compound state like a rare earth-iron-boron-based alloy, in which a rare earth element and iron are bonded together, but has a specified structure in which a rare earth element and iron are not bonded, that is, an iron component and an iron-boron alloy component are present independently of a rare earth element, the powder has high deformability and excellent moldability, thereby producing a powder compact having a high relative density. It was also found that a powder having the specified structure can be produced by specified heat treatment, specifically, heat treatment in a hydrogen-containing atmosphere, of an alloy powder composed of a rare earth-iron-boron-based alloy. In addition, it was found that a powder compact produced by compacting the resultant powder is subjected to specified heat treatment to produce a magnetic member similar to those produced from a green compact subjected to HDDR treatment and a compact produced using HDDR powder. In particular, it was found that a rare earth magnet having a high ratio of magnetic phase and excellent magnet characteristics, specifically a rare earth-iron-boron-based alloy magnet, can be produced using a magnetic member produced from a powder compact having a high relative density.

Compacting of the above-described powder in which the iron component and the iron-boron alloy component are present forms a newly formed surface on each of the magnetic particles constituting the powder under pressure during the molding. The hydrogen compound of a rare earth element is present in each of the magnetic particles, and the newly formed surfaces may be oxidized by oxidation of hydrogen compounds of the rare earth elements exposed in the newly formed surfaces. In order to prevent the oxidation, for example, molding may be performed in a non-oxidizing atmosphere, but the equipment becomes a large scale due to the need to dispose a molding apparatus in the atmosphere. Therefore, there is demanded a moldable powder which is little oxidized in an atmosphere in which oxygen is present, such as an air atmosphere.

Accordingly, based on the above-mentioned findings, the present invention proposes that magnetic particles constituting a powder for a magnetic member each have a configuration having a specified structure as described above and that an antioxidant layer is provided on the surface of each of the magnetic particles having the specified configuration.

A powder for a magnetic member of the present invention is a powder used for a raw material of a magnetic member, such as a raw material of a rare earth magnet, and includes magnetic particles which constitute the powder for a magnetic member and each of which is composed of less than 40% by volume of a hydrogen compound of a rare earth element, and the balance composed of an iron-containing material. The iron-containing material contains iron and an iron-boron alloy containing iron and boron. The hydrogen compound of a rare earth element is dispersed in a phase of the iron-containing material. In addition, an antioxidant layer having an oxygen permeability coefficient (30° C.) of less than $1.0\times10^{-11}$ $m^3\cdot m/(s\cdot m^2\cdot Pa)$ is provided on the periphery of each of the magnetic particles.

A powder compact of the present invention is used for a raw material of a magnetic member and is produced by compacting the powder for a magnetic member of the present invention. In addition, a magnetic member of the present invention is produced by heat-treating the powder compact of the present invention in an inert atmosphere or a reduced-pressure atmosphere.

Each of the magnetic particles constituting the powder for a magnetic member of the present invention includes a plurality of phases including the phase of the iron-containing material and the phase of the hydrogen compound of a rare earth element, but not a single layer of a rare earth alloy like an R—Fe—B-based alloy and R—Fe—N-based alloy. The phase of the iron-containing material is soft and rich in moldability as compared with the R—Fe—B-based alloy and R—Fe—N-based alloy (including alloys subjected to HDDR treatment) and the hydrogen compound of a rare earth element. In addition, each of the magnetic particles contains, as a main component (60% by volume or more), the iron-containing material so that the phase of the iron-containing material in the magnetic particles can be sufficiently deformed by compacting the powder of the present invention. Further, the hydrogen compound of a rare earth element is dispersed in the phase of the iron-containing material, and thus each of the magnetic particles is uniformly deformed by compacting. Consequently, by using the powder of the present invention, a powder compact having a high relative density can be easily produced. In addition, by using the powder compact having a high relative density, a magnetic body such as a rare earth magnet having a high magnetic phase ratio can be produced without sintering. Further, since the magnetic particles are engaged and bonded together by sufficient deformation of the iron-containing material, excellent bondability is exhibited. Therefore, by using the powder of the present invention, a magnetic body such as a rare earth magnet having a magnetic phase ratio of 80% by volume or more, preferably 90% by volume or more, can be produced without the need to use a large amount of a binder resin unlike in a bond magnet.

In addition, the powder compact of the present invention produced by compacting the powder for a magnetic member of the present invention does not undergo sintering unlike in a sintered magnet, and thus has no shape limit due to contraction anisotropy caused by sintering and has a high degree of freedom of shape. Therefore, by using the powder of the present invention, a complicated shape, for example, a cylindrical shape, a columnar shape, or a pot shape, can be easily formed substantially without post-processing such as cutting or the like. Further, cutting is not required, and thus it is possible to remarkably improve the raw material yield, improve productivity of a magnetic body such as a rare earth magnet, and prevent deterioration in magnetic characteristics in association with cutting.

Further, the power for a magnetic member of the present invention includes the antioxidant layer provided on the periphery of each of the magnetic particles as described above, and thus even in the case of compacting in an atmosphere containing oxygen, such as an air atmosphere, the newly formed surface formed on each of the magnetic particles during compacting can be effectively prevented from being oxidized. Therefore, by using the powder of the present invention, a decrease in the magnetic phase ratio due to the presence of oxide of a rare earth element can be suppressed, and a magnetic body such as a rare earth magnet having a high magnetic phase ratio can be produced with high productivity. Also, by using the powder of the present invention, unlike in the case of molding in a nonoxidizing atmosphere, a large-scale equipment is not required, and thus the magnetic body can be produced with high productivity.

Advantageous Effects of Invention

The powder for a magnetic member of the present invention has excellent moldability, can produce the powder compact with a high relative density of the present invention, and can be prevented from oxidation. By using the powder compact of the present invention and the magnetic member of the present invention, a magnetic body such as a rare earth magnet having a high magnetic phase ratio can be produced without sintering.

DESCRIPTION OF EMBODIMENTS

Figure 1:
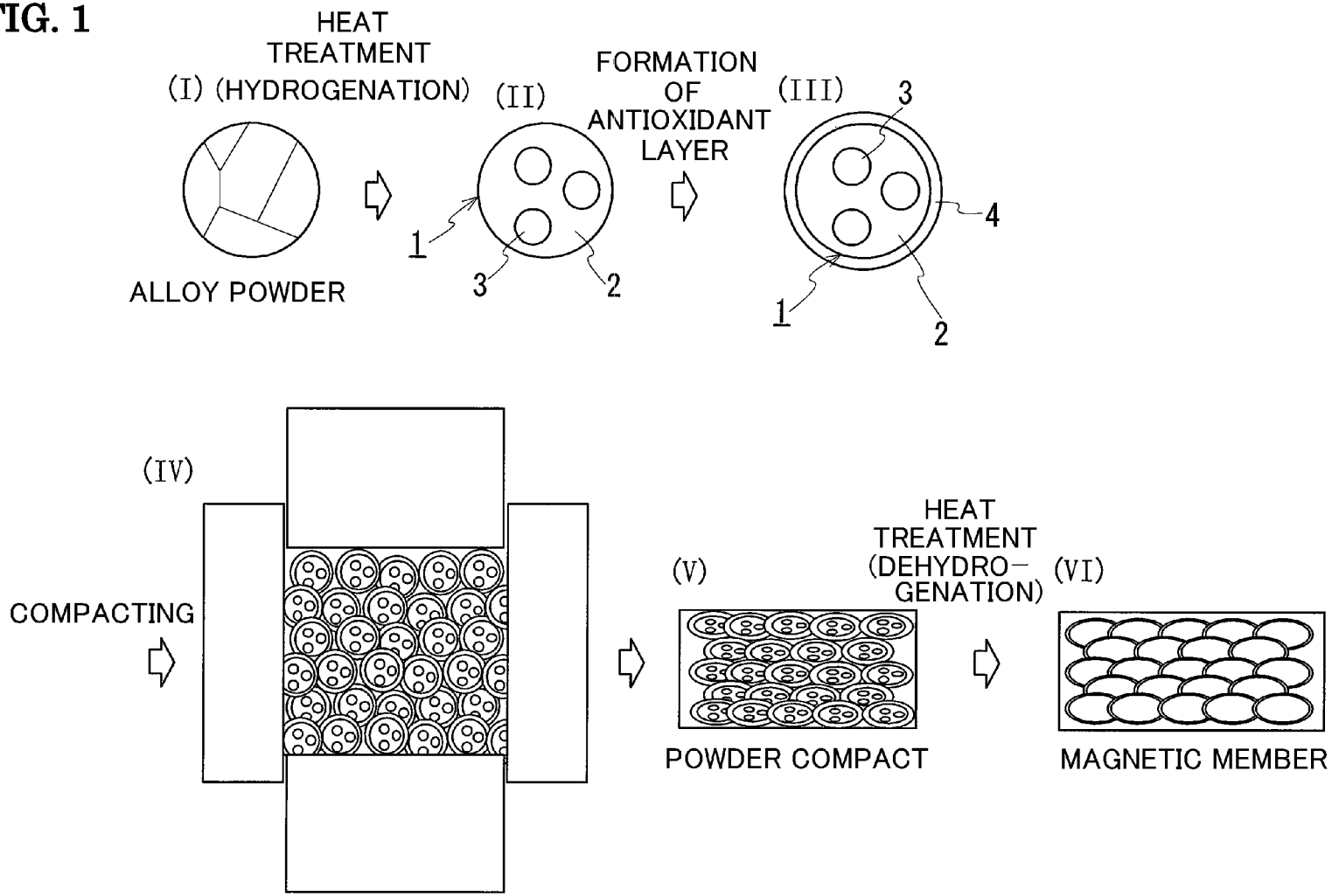
FIG. 1 is an explanatory process drawing illustrating an example of a process for producing a magnetic member using a powder for a magnetic member according to Embodiment 1 of the present invention.

The present invention is described in further detail below.

[Powder for Magnetic Member]

<<Magnetic Particles>>

Magnetic particles constituting a powder for a magnetic member of the present invention each contain an iron-containing material as a main component at a content (total content of iron and an iron-boron alloy) of 60% by volume or more. When the content of the iron-containing material is less than 60% by volume, a hydrogen compound of a rare earth element, which is a hard component, is relatively increased in amount, and thus the iron-containing component is not easily sufficiently deformed during compacting, while when the content of the iron-containing material is excessively high, magnet characteristics are degraded. Therefore, the content is preferably 90% by volume or less. On the other hand, when the powder does not contain the hydrogen compound of a rare earth element, a rare earth magnetic body such as a rare earth magnet cannot be produced. Therefore, the content of the hydrogen compound of a rare earth element exceeds 0% by volume, preferably 10% by volume or more, and less than 40% by volume. The content of the iron-containing material or the hydrogen compound of a rare earth element can be adjusted by appropriately changing the composition of a rare earth-iron-boron-based alloy used as a raw material of the powder for a magnetic member and heat treatment conditions (mainly the temperature) for producing the powder. In addition, each of the magnetic particles is allowed to contain unavoidable impurities.

The iron-containing material contains both iron and the iron-boron alloy. The iron-boron ally is, for example, $Fe_3B$. Other examples include $Fe_2B$ and FeB. In addition to the iron-boron alloy, pure iron (Fe) is added to the magnetic particles in order to improve moldability. The content of the iron-boron alloy is preferably 5% by mass to 50% by mass relative to 100% of the iron-containing material. When the content of the iron-boron alloy is 10% by mass or more, the powder can sufficiently contain boron, and the ratio of the rare earth-iron-boron-based alloy (typically $Nd_2Fe_{14}B$) in the final resultant magnetic member can be increased to 50% by volume or more. When the content of the iron-boron alloy is 50% by mass or less, moldability is excellent. The ratio of iron to the iron-boron alloy in the iron-containing material can be determined by, for example, measuring X-ray diffraction peak intensities (peak areas) and comparing the measured peak intensities. In addition, the iron-containing material may have a form in which iron is partially replaced by at least one element selected from Co, Ga, Cu, Al, Si, and Nb. In the form of the iron-containing material containing such an element, magnetic characteristics and corrosion resistance can be improved. The ratios of the iron and the iron-boron alloy present can be adjusted by appropriately changing the composition of the rare earth-iron-boron-based alloy used as a raw material for producing the powder for a magnetic member.

The rare earth element contained in each of the magnetic particles is at least one element selected from Sc (scandium), Y (yttrium), lanthanides, and actinides. In particular, at least one element selected from Nd, Pr (praseodymium), Ce (cerium), Dy (dysprosium), and Y is preferably contained, and Nd (neodymium) is particularly preferred because an R—Fe—B-based alloy magnet having excellent magnet characteristics can be produced at relatively low cost. Examples of the hydrogen compound of a rare earth element include $NdH_2$ and $DyH_2$. In a form provided with a rare earth source material described above, the rare earth element contained in each of the magnetic particles is preferably at least one selected from Nd, Pr, Ce, and Y.

Each of the magnetic particles has a specified structure in which a phase of the iron-containing material and a phase of the hydrogen compound of a rare earth element are uniformly dispersed. This dispersed state represents that in each of the magnetic particles, the phase of the hydrogen compound of a rare earth element and the phase of the iron-containing material are present adjacent to each other, and the distance between the phases of the rare earth element hydrogen compound adjacent to each other with the phase of the iron-containing material interposed therebetween is 3 μm or less. Typical examples of the structure include a layered form in which both phases are present in a multilayer structure, and a granular form in which the phase of the hydrogen compound of a rare earth element is granular, and the granular hydrogen compound of a rare earth element is dispersed in the phase of the iron-containing material serving as a mother phase.

Depending on the heat treatment conditions (mainly the temperature) for producing the powder for a magnetic member, the presence form of both phases tends to become the granular form at the increased temperature and become the layered form at the temperature close to the disproportionation temperature described below.

By using the powder having the layered form, a rare earth magnet having, for example, a magnetic phase ratio equal to that (about 80% by volume) of a bond magnet can be formed without using a binder resin. In the case of the layered form, the sentence "the phase of the hydrogen compound of a rare earth element and the phase of the iron-containing material are adjacent to each other" represents a condition in which both phases are substantially alternately laminated in a cross-section of each of the magnetic particles. In addition, in the case of the layered form, the expression "the distance between the adjacent phases of the hydrogen compound of a rare earth element" refers to, in the cross-section, the center-to-center distance between the phases of the hydrogen compound of a rare earth element adjacent to each other with the phase of the iron-containing material disposed therebetween.

In the granular form, the iron-containing material component is uniformly present around the particles composed of the hydrogen compound of a rare earth element, and thus the iron-containing material component can be more easily deformed than in the layered form. For example, a powder compact having a complicated shape such as a cylindrical shape, a columnar shape, or a pot shape, and a high-density powder compact having a relative density of 85% or more, particularly 90% or more, can be easily formed. In the case of the granular form, the sentence "the phase of the hydrogen compound of a rare earth element and the phase of the iron-containing material are adjacent to each other" typically represents a condition in which in a cross-section of each of the magnetic particles, the iron-containing material is present to cover the peripheries of particles of the hydrogen compound of a rare each element, and the iron-containing material is present between the adjacent particles of the hydrogen compound of a rare earth element. In addition, in the case of the granular form, the expression "the distance between the adjacent phases of the hydrogen compound of a rare earth element" refers to, in the cross-section, the center-to-center distance between the adjacent two particles of the hydrogen compound of a rare earth element.

The distance can be measured by, for example, removing the phase of the iron-containing material by etching the section to extract the hydrogen compound of a rare earth element, by removing the hydrogen compound of a rare earth element to extract the iron-containing material according to the type of the solution used, or by analyzing the composition of the section with an EDX (energy dispersive X-ray spectroscopy) apparatus. With the distance of 3 μM or less, input of excessive energy is not required for appropriately heat-treating the powder compact to form the magnetic member, and deterioration in characteristics due to coarsening of crystals of the rare earth-iron-boron-based alloy can be suppressed. In order to allow the iron-containing material to be sufficiently present between the phases of the hydrogen compound of a rare earth element, the distance is preferably 0.5 μm or more, particularly 1 μM or more. The distance can be adjusted by controlling the composition of the rare earth-iron-born-based alloy used as a raw material or controlling the heat treatment conditions, particularly the temperature, of the heat treatment for producing the powder for a magnetic member within a specified range. For example, the distance tends to be increased by increasing the ratio (atomic ratio) of iron or boron in the rare earth-iron-boron-based alloy used as the raw material or increasing the temperature of the heat treatment within the specified range.

When the average particle diameter of the magnetic particles is 10 μm or more and 500 μm or less, the ratio of the surface occupied by the hydrogen compound of a rare earth element in each magnetic particle can be relatively decreased, and some degree of effect of suppressing oxidation of the magnetic particles is expected. In addition, the magnetic particles each contain the phase of the iron-containing material and thus have excellent moldability as described above, and thus a powder compact having low porosity and a high relative density can be formed even by using a coarse powder having an average particle diameter of 100 μm or more. However, an excessively large average particle diameter causes a decrease in relative density of the powder compact, and thus the average particle diameter is preferably 500 μm or less. The average particle diameter is more preferably 50 μm or more and 200 μm or less.

The magnetic particles may have a form in which the circularity of a section is 0.5 or more and 1.0 or less. The circularity satisfying the above-described range can preferably causes the effect that the antioxidant layer and an insulating coating described below can be easily formed to a uniform thickness and that damage to the antioxidant layer during compacting can be suppressed. The effect is more achieved as the shape of the magnetic particles becomes closer to a sphere, i.e., the circularity becomes closer to 1.

Another form in which at least part of boron elements are substituted by carbon may be used. For example, the powder for a magnetic member used as a raw material of a rare earth-iron-carbon-based alloy magnet may have a form in which the iron-containing material contains iron and an iron-carbon alloy containing carbon. Like the above-described powder for a magnetic member containing the iron-boron alloy, the powder for a magnetic member which contains the iron-carbon alloy also contains the phase of the iron-containing material and thus has excellent moldability. In each of the items described above and below, the terms "iron-boron alloy" and "rare earth-iron-boron alloy" can be replaced by the terms "iron-carbon alloy" and "rare earth-iron-carbon alloy". Typical examples of the rare earth-iron-carbon-based alloy include $Nd_2Fe_{14}C$.

<<Antioxidant Layer>>

In addition, each of the magnetic particles is characterized by including the antioxidant layer provided on the periphery thereof. The anti-oxidation layer particularly functions to prevent oxidation of the newly formed surface formed on each of the magnetic particles during compacting. In order to achieve this effect, the antioxidant layer is provided to cover the entire periphery of each magnetic particle, and the oxygen permeability coefficient (30° C.) is less than $1.0\times10^{-11}$ $m^3\cdot m/(s\cdot m^2\cdot Pa)$ so that the magnetic particles are sufficiently cut off from oxygen in the ambient atmosphere such as the air atmosphere (outside air). When the oxygen permeability coefficient (30° C.) is $1.0\times10^{-11}$ $m^3\cdot m/(s\cdot m^2\cdot Pa)$ or more, the newly formed surfaces are oxidized to form oxides during compacting, for example, in an atmosphere containing oxygen, such as an air atmosphere, and the presence of oxides results in a decrease in magnetic phase ratio of the magnetic member. Therefore, the antioxidant layer preferably has as a small oxygen permeability coefficient (30° C.) as possible and more preferably $0.01\times10^{-11}$ $m^3\cdot m/(s\cdot m^2\cdot Pa)$ or less, without a lower limit.

Further, the antioxidant layer preferably has a moisture permeability coefficient of less than $1000\times10^{-13}$ kg/(m·s·MPa). Under a humid condition (e.g., air temperature of about 30° C./humidity of about 80%) where a relatively large amount of moisture (typically water vapor) is present in an ambient atmosphere such as an air atmosphere, the newly formed surfaces of the magnetic particles may be oxidized by contact with moisture. Therefore, oxidation with moisture can be effectively prevented as long as the antioxidant layer is made of a material having a low moisture permeability coefficient. The moisture permeability coefficient is also preferably as low as possible and more preferably $10\times10^{-13}$ kg/(m·s·MPa) or less without a low limit.

The antioxidant layer can be made of any one of various materials, for example, a resin, ceramic (oxygen impermeable), a metal, a vitreous material, and the like, which satisfy the oxygen permeability coefficient and moisture permeability coefficient within the above-described ranges. In particular, a resin has the effect (1) that the resin can sufficiently follow deformation of each of the magnetic particles during compacting, and thus the newly formed surface of each magnetic particle can be prevented from being exposed during deformation, and the effect (2) that the resin is burned out by heat treatment of the powder compact, and thus a decrease in the magnetic phase ratio due to the residue of the antioxidant layer can be suppressed. In particular, a ceramic or metal has the high antioxidant effect, and a vitreous material can function as an insulating coated film as described below.

The antioxidant layer may include a single layer or multiple layers. Examples of the form of the antioxidant layer include a single layer form including only a low-oxygen permeable layer composed of a material having an oxygen permeability coefficient (30° C.) of less than $1.0\times10^{-11}$ $m^3\cdot m/(s\cdot m^2\cdot Pa)$, a single layer form including a low-oxygen-moisture permeable layer composed of a material having an oxygen permeability coefficient (30° C.) of less than $1.0\times10^{-11}$ $m^3\cdot m/(s\cdot m^2\cdot Pa)$ and a moisture permeability coefficient (30° C.) of less than $1000\times10^{-13}$ kg/(m·s·MPa), and a multilayer form including a laminate of the low-oxygen permeable layer and a low-moisture permeable layer composed of a material having a moisture permeability coefficient (30° C.) of less than $1000\times10^{-13}$ kg/(m·s·MPa).

As a material constituting the low-oxygen permeable layer, a resin selected from polyamide resins, polyesters, and polyvinyl chloride can be used. A typical example of the polyamide resins is nylon 6. The nylon 6 is preferred because the oxygen permeability coefficient (30° C.) is as small as $0.0011\times10^{-11}$ $m^3\cdot m/(s\cdot m^2\cdot Pa)$. As a material constituting the low-moisture permeable layer, a resin such as polyethylene, a fluorocarbon resin, or polypropylene can be used. The polyethylene is preferred because the moisture permeability coefficient (30° C.) is as small as $7\times10^{-13}$ kg/(m·s·MPa) to $60\times10^{-13}$ kg/(m·s·MPa).

When the antioxidant layer includes a laminate of the low-oxygen permeable layer and the low-moisture permeable layer, either of both layers may be disposed in the inside (the magnetic particle side) or the outside (surface side). However, when the low-oxygen permeable layer and the low-moisture permeable layer are disposed on the inside and the outside, respectively, it is expected that oxidation can be more effectively prevented. In addition, both the low-oxygen permeable layer and the low-moisture permeable layer are preferably composed of the resins as described above because of the excellent adhesion between both layers.

Although the thickness of the antioxidant layer can be appropriately selected, an excessively small thickness makes it impossible to sufficiently achieve the antioxidant effect and to sufficiently fix the particles of a rare earth source material described below. On the other hand, an excessively large thickness causes a decrease in density of the powder compact and difficulty in, for example, forming the powder compact having a relative density of 85% or more and removing the antioxidant layer by burning. Therefore, the thickness of the antioxidant layer is preferably 10 nm or more and 1000 nm or less. More specifically, in the case of the antioxidant layer having a multilayer structure, such as the two-layer structure, or the single-layer structure provided with only the low-oxygen permeable layer or the low-moisture permeable layer described above, preferably, the thickness of each of the layers is 10 nm or more and 500 nm or less, and the total thickness is 20 nm or more and 1000 nm or less. In particular, the total thickness of the antioxidant layer is preferably 2 times or less of the diameter of the magnetic particles, and 100 nm or more and 300 nm or less because oxidation and a decrease in density can be suppressed, and moldability is excellent.

A typical form of the antioxidant layer is one in which it is provided directly above each magnetic particle. Another form is one in which the antioxidant layer is provided on another coating (an insulating coating or a coating composed of a rare earth source material described below) provided directly above each magnetic particle.

<<Heat-Resistant Precursor Layer>>

As the powder for a magnetic member which has excellent moldability and which produces a rare earth magnet having high coercive force even in a high-temperature environment, a configuration is proposed, in which each of the magnetic particles constituting the powder for a magnetic member has the above-described specified structure, and a heat-resistant precursor layer used as a raw material for forming a heat-resistant coercive force layer described below is provided on the surface of each magnetic particle. Specifically, the powder for a magnetic member is a powder used for a raw material of a magnetic member such as a raw material of a rare earth magnet, and includes the magnetic particles which constitute the powder for a magnetic member and each of which includes less than 40% by volume of the hydrogen compound of a rare earth element and the balance composed of the iron-containing material. The rare earth element is at least one selected from Nd, Pr, Ce, and Y. The iron-containing material contains iron and an iron-boron alloy containing iron and boron. The hydrogen compound of the rare earth element is dispersed in the phase of the iron-containing material. In addition, the heat-resistant precursor layer is provided on each of the magnetic particles. The heat-resistant precursor layer contains the rare earth source material composed of at least one of a compound and an alloy which does not contain oxygen and contains a rare earth element different from that in the magnetic particles, specifically at least one element of Dy and Tb. This configuration is based on a finding described below.

For example, parts disposed in an engine room of an automobile are required to operate satisfactorily in a high temperature region of about 100° C. to 200° C. However, conventional rare earth magnets composed of Nd—Fe—B-based alloys have high coercive force at room temperature but is greatly demagnetized at about 80° C. Patent Literature 2 discloses that in order to improve basic coercive force so as to allow an alloy to have high coercive force even in a high-temperature environment, Nd of a Nd—Fe—B-based alloy (mother alloy) is partially substituted by a rare earth element having higher coercive force than that of Nd, specifically Dy or Tb (terbium), to form a Dy—Fe—B-based alloy, and a mixture of a HDDR powder and a rare earth oxide such as $Dy_2O_3$ is heat-treated.

However, when a Dy—Fe—B-based alloy is formed by substitution of the mother alloy with about 10% by mass to 30% by mass of Dy or Tb so that high coercive force can be maintained even in a high-temperature environment, a basic characteristic of a magnet, such as saturation magnetization, is degraded. In addition, Dy and Tb are generally expensive as compared with Nd, thereby causing in crease in cost. Further, as described in Patent Literature 2, when a rare earth oxide is mixed with a HDDR powder, the degree of freedom of shape is small due to the use of the HDDR powder as described above.

On the other hand, when the powder compact is produced from the powder for a magnetic member having the above-described specified structure (the structure in which the hydrogen compound of the rare earth element is dispersed in the phase of the iron-containing material) and then heat-treated to produce a magnetic member, unlike in a sintered body, grain boundaries of the powder used as the raw material can be observed in the resultant magnetic member and in a rare earth magnet produced by magnetizing the magnetic member. In addition, it was found that when a coating layer (heat-resistant coercive force layer) containing a rare earth element, which has higher basis coercive force than the Nd, such as Dy or Tb, is present on each of the grain boundaries, i.e., the surface of each of the alloy particles constituting the magnetic member, high coercive force can be maintained even at an increased operation temperature. Also, it was found that the heat-resistant coercive force layer can be formed as described below. The powder for a magnetic member having the above-described specified structure is prepared, and a material containing a rare earth element (the above-described Dy or Tb) with relatively high coercive force is provided on the surface of each of the magnetic particles constituting the powder to form the rare earth element supply source for forming the heat-resistant coercive force layer. Examples of such a material include a compound (excluding an oxide) with a nonmetallic element, an intermetallic compound with a metallic element other than the rare earth element, and an alloy with a metallic element other than the rare earth element. The powder compact is formed using the powder containing the rare earth source material and subjected to specified heat treatment. The heat treatment decomposes the rare earth source material present on the surface of the each of the magnetic particles to generate the rare earth element (the element to be used for forming a rare earth-iron-boron composite material having high coercive force) and, at the same time, forms another compound (rare earth-iron-boron composite material) containing the generated rare earth element and the elements (a rare earth element such as Nd, Fe, and B) as the main components of the magnetic member. In this way, the composite material constituting the heat-resistant coercive force layer can be formed from the components of the magnetic particles and the rare earth generated by decomposition of the rare earth source material present in the powder for a magnetic member.

The magnetic member produced by the specified heat treatment of the powder compact which is formed by compacting the powder for a magnetic member provided with the heat-resistant coercive force layer includes the heat-resistant coercive force layer which contains the rare earth element with high coercive force and which is provided on the surface (grain boundary) of each of the alloy particles constituting the magnetic member and can thus has high coercive force even in a high-temperature environment. Therefore, a rare earth magnet formed using the magnetic member as a raw material has excellent magnet characteristics even in use at high temperature.

The heat-resistant coercive force layer contains the rare earth source material composed of at least one of a compound and an alloy containing Dy or Tb, which is a rare earth element having relatively higher basic coercive force than the rare earth element, such as Nd, Pr, Y, or Ce, contained in the magnetic particles. More specifically, the rare earth source material is at least one selected from hydrides, iodides, fluorides, chlorides, bromides, intermetallic compounds, and alloys. In particular, the abundance of Dy is larger than Tb, and thus the raw material can be stably secured. In addition, the rare earth source material does not contain oxygen. That is, when the rare earth source material is a compound, the compound other than an oxide is used. Here, since oxides of rare earth elements are very stable, it is very difficult to remove oxygen from the oxides. Therefore, the rare earth source material contained in the heat-resistant coercive force layer is a material other than an oxide so that the heat-resistant coercive force layer can be easily formed by heat-treating the powder compact as described above to decompose the compound or alloy containing the rare earth element, such as Dy, and to generate the rare earth element such as Dy.

As the compound of the rare earth element which can easily form the heat-resistant coercive force layer by heat treatment (dehydrogenation described below) of the powder compact, for example, at least one selected from hydrides, iodides, fluorides, chloride, and bromides can be used. The compound can be easily decomposed by the heat treatment into the rare earth element and hydrogen, iodine, fluorine, chlorine, or bromine, so that Dy or Tb can be extracted. The heat-resistant precursor layer may have a form containing only one of the compound, and an intermetallic compound and an alloy described below, or a form containing a plurality of compounds, intermetallic compounds, or alloys.

When the compound in the heat-resistant precursor layer is the hydride, hydrogen compounds can be used as both the compound of the rare earth element in the magnetic particles and the compound of the rare earth element in the heat-resistant precursor layer, which is present on the surface of each of the magnetic particles, and thus the conditions of the heat treatment can be desirably easily controlled. When the compound is the iodide, the heat-resistant precursor layer can be easily formed by, for example, melting the iodide and applying it on the surface of each magnetic particle because of the relatively low melting point. When the compound is the fluoride, chloride, or bromide, the compound is more inactive than the hydride and is thus little oxidized and has excellent anti-oxidation.

Other examples of the rare earth source material which can form the heat-resistant coercive force layer include intermetallic compounds and alloys of the rare earth element with metallic elements other than the rare earth element. Specifically, intermetallic compounds and alloys of Dy with at least one metallic element selected from Mn, Fe, Co, Ni, Cu, Zn, and Ga can be used. For example, Dy—Ni-based alloys have many types of intermetallic compounds, some of which have a eutectic point of 950° C. or less. For example, the eutectic point is present near Dy-30 atomic % Ni, and $Dy_3Ni$ has a melting point (primary crystal temperature) of 693° C. Such a low eutectic point permits a liquid phase to be satisfactorily formed by adjusting the temperature of heat treatment (dehydrogenation) performed for the powder compact, so that the rare earth element such as Dy can be efficiently supplied to the magnetic particles from the liquid phase. Therefore, with the heat-resistant precursor layer containing the intermetallic compound or alloy, the heat-resistant coercive force layer can be formed by the heat treatment (dehydrogenation). Examples of the compounds having a low eutectic point include $Dy_3Ni$ and $Dy_3Ni_2$.

Examples of the form of the heat-resistant precursor layer include (1) the form of a coated film composed of the rare earth source material, i.e., the compound (or intermetallic compound) or alloy containing the rare earth element such as Dy, and (2) a form provided with the rare earth source material and a fixing layer provided to cover at least a portion of the surface of the rare earth source material and to fix the rare earth source material to the surface of each of the magnetic particles. In the form (2), when the rare earth source material is granular, the heat-resistant precursor layer can be easily formed, and a configuration containing a plurality of compounds or alloys can be easily formed.

Then, as a result the heat treatment (dehydrogenation) of the powder compact, the rare earth element such as Dy generated from the rare earth source material by decomposition diffuses and permeates into each of the magnetic particles constituting the power compact from the surface thereof, forming the heat-resistant coercive force layer composed of a composite material which contains the rare earth element and the constituent elements of the magnetic particles. That is, in the surface layer region of each of the magnetic particles, at least part of the rare earth element such as Nd is substituted by the rare earth element such as Dy to form the heat-resistant coercive force layer. Therefore, the thickness of the coated film (1) or the average particle diameter and adding amount of particles (hereinafter, referred to as "supply source particles") composed of the compound (may be an intermetallic compound) or alloy in the form (2), and the heat treatment conditions for the powder compact are preferably adjusted so that the amount of substitution is 30% to 100% of the rare earth element of Nd, and the thickness of the heat-resistant coercive force layer is about 100 nm to 200 nm. The thickness of the coating is preferably 50 nm or more and 1000 nm or less. With the supply source particles having an average particle diameter of 0.1 μm (100 nm) or more, the compound or alloy are allowed to stably present, while with the supply source particles having an average particle diameter of 5 μm (5000 nm) or less, a decrease in packing density of the powder composed of the magnetic particles can be suppressed. In addition, the amount of the supply source particles added is preferably an amount sufficient to cover 15% to 50% of the surface areas of the magnetic particles.

The shape of the supply source particles is not particularly limited as long as it is a small piece. For example, a spherical outer shape and a foil strip may be used. When the rare earth source material is the compound, the supply source particles can be produced by grinding a lump or foil of the compound. When the rare earth source material is the intermetallic compound or alloy, the supply source particles can be produced by grinding an ingot formed by melt casting or using a gas atomization method. Alternatively, a commercial product (powder) can be used as the supply source particles.

The powder for a magnetic member of the present invention may have a configuration in which the rare earth element in the magnetic particles is at least one selected from Nd, Pr, Ce, and Y, and the heat-resistant precursor layer is provided on the surface of each of the magnetic particles, the heat-resistant precursor layer including the rare earth source material and a resin layer that is composed of a resin and that covers at least a portion of the rare earth source material, the resin having an oxygen permeability coefficient satisfying the above-described specified range. In this configuration, at least a portion of the surface of each magnetic particle is covered with the resin layer, and preferably the entire periphery of each magnetic particle is covered with the resin layer. In the preferred configuration, the resin layer functions as the antioxidant layer.

The resin layer has the advantage that (1) it can sufficiently follow deformation of each of the magnetic particles during compacting, (2) the newly formed surface of each of the magnetic particles deformed by compacting can be prevented from being oxidized, and (3) it is burned out by the heat treatment of the powder compact and thus can suppress a decrease in magnetic phase ratio due to the residue of the resin. Therefore, the powder having the configuration including the resin layer is excellent in moldability and anti-oxidation and produces the magnetic member having high coercive force even at a high temperature.

From the viewpoint of anti-oxidation, the resin layer is preferably provided in the case where the rare earth source material includes the coated film. When the rare earth source material is granular, the resin layer functions as both the antioxidant layer and the fixing layer. A specific example of the configuration of the powder for magnetic member of the present invention is one in which the rare earth source material is granular, and the supply source particles are fixed to the surfaces of the magnetic particles by the fixing layer (antioxidant layer) composed of the resin layer.

The resin layer preferably has a configuration further including a low-moisture permeable layer composed of a resin which has a moisture permeability coefficient (30° C.) satisfying the above-described specified range because the above-described oxidation with moisture can be prevented. The resin layer may have any one of a single-layer structure including only the low-oxygen permeable layer, a single-layer structure including the low-oxygen-moisture permeable layer, and a multilayer structure including a laminate of the low-oxygen permeable layer and the low-moisture permeable layer. In particular, the supply source particles are preferably fixed by the low-oxygen permeable layer disposed on the magnetic particle side because the rare earth element such as Dy, which contributes to maintenance of coercive force in a high-temperature environment, is easily allowed to present on the grain boundaries of the magnetic member. As described for the antioxidant layer, the thickness of the resin layer is preferably 10 nm or more and 500 nm or less per layer and 20 nm or more and 1000 nm or less in total. In particular, when the thickness of the layer functioning as the fixing layer is, for example, equivalent to or smaller than the average particle diameter of the supply source particles, particularly 200 nm or more and 1000 nm or less, dropping, oxidation, and decrease in density of the supply source particles can be suppressed, and moldability is excellent.

<<Insulating Coating>>

The powder for a magnetic member may have a configuration further including an insulating coating provided on the periphery of each particle and composed of an insulating material. By using the powder including the insulating coating, a magnetic member having a high electric resistance can be produced, and an eddy current loss can be decreased by, for example, using the magnetic member for a raw material of a motor magnet. Examples of the insulating coating include crystal coated films and amorphous glass coated films of oxides of Si, Al, Ti, and the like; and coated films of metal oxides such as ferrite Me—Fe—O (Me=a metal element such as Ba, Sr, Ni, or Mn), magnetite ($Fe_3O_4$), $Dy_2O_3$, and the like, resins such as silicone resins, and organic-inorganic hybrid compounds such as silsesquioxane compounds. In order to improve thermal conductivity, a SiN- or SiC-based ceramic coating may be provided. The crystal coated films, glass coated films, oxide coated films, and ceramic coated films may have an antioxidant function, and in this case, oxidation can be further prevented by providing such a coating in addition to the antioxidant layer. In a configuration including the insulating coating and the ceramic coating, preferably, the insulating coating is provided in contact with the surface of each of the magnetic particles, and the ceramic coating and the antioxidant layer are provided on the insulating coating. In the configuration including the heat-resistant precursor layer, preferably, the heat-resistant precursor layer is provided in contact with the surface of each of the magnetic particles, and the insulating coating and the ceramic coating are provided on the heat-resistant precursor layer. In addition, the insulating coating can be used as the fixing layer for fixing the supply source particles constituting the heat-resistant precursor layer.

[Method for Producing Powder for Magnetic Member]

The powder for a magnetic member can be produced by, for example, a production method including a preparation step, a hydrogenation step, and a coating step described below.

Preparation step: a step of preparing an alloy powder composed of a rare earth-iron-boron-based alloy (for example, $Nd_2Fe_{14}B$)

Hydrogenation step: a step of heat-treating the alloy powder in an atmosphere containing hydrogen element at a temperature equivalent to or higher than the disproportionation temperature of the rare earth-iron-boron-based alloy, thereby producing a phase of a hydrogen compound of a rare earth element and a phase of an iron-containing material containing iron and an iron-boron alloy, which contains iron and boron, and forming a base powder in which the phase of the hydrogen compound of the rare earth element is dispersed in the phase of the iron-containing material Coating step (antioxidation): a step of forming an antioxidant layer on the surface of each of the magnetic particles constituting the base powder, the antioxidant layer having an oxygen permeability coefficient (30° C.) of less than $1.0\times10^{-11}$ $m^3\cdot m/(s\cdot m^2\cdot Pa)$ In order to produce the powder for a magnetic member provided with the heat-resistant precursor layer, the following coating step (heat resistance) may be provided.

Coating step (heat resistance): a step of forming the heat-resistant precursor layer containing the rare earth source material on the surface of each of the magnetic particles constituting the base powder, the rare earth source material including at least one of oxygen-free compounds and alloys containing at least one of Dy and Tb <<Preparation Step>>

The alloy powder can be produced by, for example, grinding a melt cast ingot composed of a rare earth-iron-boron-based alloy or a foil-shaped material, which is obtained by a rapid solidification method, with a grinder such as a jaw crusher, a jet mill, or a ball mill, or by using an atomization method such as a gas atomization method. In particular, use of the gas atomization method can form a powder (oxygen concentration: 500 ppm by mass or less) containing substantially no oxygen by forming the powder in a non-oxidizing atmosphere. That is, in the magnetic particles constituting the alloy powder, the oxygen concentration of 500 ppm by mass or less can be used as an index which indicates a powder produced by the gas atomization method in a non-oxidizing atmosphere. In addition, as the alloy powder composed of the rare earth-iron-boron-based alloy, a powder produced by a known powder producing method or the atomization method and further grinding the powder may be used. The particle size distribution and the shape of the magnetic particles of the powder can be adjusted by appropriately changing the grinding conditions or the production conditions. For example, a powder having high sphericity and excellent filling properties during molding can be easily produced by the atomization method, and for example, a powder having sphericity of 0.5 to 1.0 close to a spherical shape can be easily produced. In other words, the sphericity satisfying the above range is used as an index indicating that the powder is produced by the atomization method. The magnetic particles constituting the alloy powder may be each composed of a polycrystal or a single crystal. Particles composed of a single crystal can be formed by appropriate heat treatment of magnetic particles composed of a polycrystal.

The size of the alloy powder prepared in the preparation step is substantially the same as the powder for a magnetic member of the present invention when the heat treatment for hydrogenation in a subsequent step is performed so as substantially not to change the particle size. Since the powder for a magnetic member of the present invention is excellent in moldability as described above, the powder can be made relatively coarse to have an average particle diameter of about 100 μm. Therefore, the alloy powder having an average particle diameter of about 100 μm can be used. Such a coarse alloy powder can be produced by coarsely grinding a melt cast ingot or by using the atomization method such as a melt atomization method. Since such a coarse alloy powder can be used, the need for fine grinding for forming fine particles of 10 μm or less, for example, a raw material powder (powder constituting a compact before sintering) used for producing a sintered magnet, can be eliminated, thereby permitting an attempt to decrease the production cost by shortening the production process.

<<Hydrogenation Step>>

This step is a step of heat-treating the prepared alloy powder in a hydrogen element-containing atmosphere to separate the alloy into the rare earth element, iron, and the iron-boron alloy and to prepare the base powder by combining the rare earth element with hydrogen.

As the hydrogen element-containing atmosphere, a single atmosphere containing only hydrogen ($H_2$), or a mixed atmosphere containing hydrogen ($H_2$) and inert gas, such as Ar or $N_2$, can be used. The heat treatment temperature in the hydrogenation step is equal to or higher than the temperature at which disproportionation reaction of the rare earth-iron-boron-based alloy proceeds, i.e., the disproportionation temperature. The disproportionation reaction is a reaction of separating the hydrogen compound of a rare earth element, ion, and the iron-boron alloy from each other by preferential hydrogenation of the rare earth element, and the lower limit temperature at which the reaction takes place is referred to as the disproportionation temperature. The disproportionation temperature varies with the composition of the alloy and the type of the rare earth element. For example, when the rare earth-iron-boron-based alloy is $Nd_2Fe_{14}B$, the heat treatment temperature is, for example, 650° C. or more. With the heat treatment temperature near the disproportionation temperature, the above-described layered form is produced, while with the heat treatment temperature 100° C. or more higher than the disproportionation temperature, the above-described granular form is produced. The higher the heat treatment temperature in the hydrogenation step is, the more easily the iron phase and the iron-boron alloy phase appear, and the less the hard hydrogen compound of a rare earth element, which is precipitated at the same time, becomes an inhibitor factor to deformation, thereby enhancing moldability. However, with an excessively high heat treatment temperature, a trouble such as melt fixing of the powder occurs, and thus the heat treatment temperature is preferably 1100° C. or less. In particular, when the rare earth-iron-boron-based alloy is $Nd_2Fe_{14}B$, with the relatively low heat treatment temperature of 750° C. or more and 900° C. or less in the hydrogenation step, a fine structure having the small distance is realized, and a rare earth magnet having high coercive force can be easily formed by using such a powder. The retention time is, for example, 0.5 hours or more and 5 hours or less. The heat treatment corresponds to the treatment up to the disproportionation step of the above HDDR treatment, and known disproportionation conditions can be applied.

<<Coating Step (Anti-Oxidation)>>

This step is a step of forming the anti-oxidant layer on the surface of each of the magnetic particles constituting the resultant base powder.

In order to form the antioxidant layer, any one of a dry method and a wet method can be used. The dry method is preferably performed in a nonoxidizing atmosphere, for example, an inert atmosphere such as Ar or $N_2$, or a reduced-pressure atmosphere in order to prevent oxidation of the surface of each magnetic particle due to contact with oxygen in the atmosphere. The wet method is not required to be performed in the above-described inert atmosphere because of substantially no contact of the surface of each magnetic particle with oxygen in the atmosphere, and for example, the antioxidant layer can be formed in an air atmosphere. Therefore, the wet method is preferred because it exhibits excellent workability in forming the antioxidant layer and is capable of easily forming the antioxidant layer to a uniform thickness on the surface of each magnetic particle.

For example, when the antioxidant layer is formed by the wet method using a resin or a vitreous material, a wet-dry coating method or a sol-gel method can be used. More specifically, a solution prepared by dissolving and mixing a raw material in a proper solvent is mixed with the base powder, and then the antioxidant layer can be formed by curing the material and drying the solvent. When the antioxidant layer is formed by the dry method using a resin, for example, a powder coating method can be used. When the antioxidant layer is formed by the dry method using a ceramic or a metal, a PVD method such as sputtering, a vapor deposition method such as a CVD method, or a mechanical alloying method can be used. When the antioxidant layer is formed by the wet method using a metal, various plating methods can be used.

In the configuration including the insulating coating and the ceramic coating, it is preferred that the insulating coating is formed on the surface of the base powder, and then the antioxidant layer and the ceramic layer are formed thereon.

<<Coating Step (Heat Resistance)>>

This step is a step of forming the heat-resistant precursor layer on the surface of each of the magnetic particles constituting the resultant base powder.

When the heat-resistant precursor layer is the coated film, for example, a forming method described below can be used.

(I) A metal coating of a rare earth element, such as Dy, is formed on the surface of each magnetic particle by a deposition method such as a physical vapor deposition method (PVD method) or a plating method, and then the metal coated film is heat-treated in an appropriate atmosphere (for example, a hydrogen element-containing atmosphere) so that a desired compound such as the hydride can be produced.

(II) An evaporation source for deposition is prepared so that a desired alloy such as the above-described Dy—Ni-based alloy can be formed on the surface of each magnetic particle by the deposition method such as the physical vapor deposition method (PVD method). For example, a rare earth element such as Dy and a metal element such as Ni are prepared as the evaporation source, and both elements are simultaneously supplied to deposit a film, or an alloy containing a rare earth element, such as a Dy—Ni-based alloy, is prepared as the evaporation source for deposition.

(III) As described above, a desired compound or alloy, such as an iodide, is melted and applied to the surface of each of the magnetic particles.

(IV) The magnetic particles are mixed with a desired alloy such as the Dy—Ni-based alloy, by mechanical alloying to form the alloy coating on the surface of each of the magnetic particles.

The powder for a magnetic member of the present invention can also be produced by further forming a resin layer (antioxidant layer) composed of the above-described resin having the antioxidant function after forming the heat-resistant precursor layer. The resin layer can be formed by using the above-described wet method such as the wet-dry coating method or a sol-gel method, or the dry method such as the powder coating method. More specifically, a solution prepared by dissolving and mixing the resin in a proper solvent is mixed with the magnetic particles including the heat-resistant precursor layer (coated film) to form the resin layer on the coated film by curing the resin and drying the solvent.

When the heat-resistant precursor layer has the configuration including the supply source particles and the fixing layer, for example, a forming method described below can be used.

(I) The supply source particles are mixed with the constituent material of the fixing layer, and the resultant mixture is applied to the surface of each of the magnetic particles.

(II) The constituent material of the fixing layer is applied to the surface of each of the magnetic particles, and then the supply source particles are adhered.

As the constituent material of the fixing layer, as described above, a resin having an oxygen permeability coefficient satisfying the specified range can be preferably used. In this case, the heat-resistant precursor layer can be formed by mixing a solution prepared by dissolving and mixing the resin in a proper solvent and the base powder with the supply source particles separately prepared, and then curing the resin and drying the solvent, or by mixing the solution with the base powder, adhering the supply source particles to the resin in an uncured state, and then completely curing the resin. The resin layer in the heat-resistant precursor layer functions as the antioxidant layer.

In order to form the heat-resistant precursor layer, as described above, any one of the dry method and the wet method can be used. As described above in the formation of the antioxidant layer, the dry method (e.g., the PVD method) is preferably performed in the above-described nonoxidizing atmosphere. As described above, the wet method can be performed in the air atmosphere so that the workability in forming the heat-resistant precursor layer is excellent, and the coated film and the resin layer can be easily formed to a uniform thickness on the surface of each of the magnetic particles.

In the configuration where the insulating coating and the ceramic coating are separately provided, the heat-resistant precursor layer is formed on the surface of the base powder, and then the insulating coating may be appropriately formed thereon.

[Powder Compact]

A powder compact of the present invention can be produced by compacting the powder for a magnetic member of the present invention produced as described above. Since the powder produced as described above has excellent moldability, the powder compact having a high relative density (actual density relative to the true density of the powder compact) can be formed. For example, a form of the powder compact of the present invention has a relative density of 85% or more. By using the powder compact having such a high density, a magnetic body such as a rare earth magnet having a high ratio of magnetic phase can be produced. The ratio of magnetic phase can be increased by increasing the relative density. However, when the constituent components of the antioxidant layer and the fixing layer are burned off in the heat treatment step for forming the magnetic member or the separately provided heat treatment step for removing the coating, the excessively high relative density makes it difficult to sufficiently burn out the constituent components. Therefore the relative density of the powder compact is considered to be preferably about 90% to 95%. In addition, when the relative density of the powder compact is increased, it is preferred to decrease the thickness of the antioxidant layer and the fixing layer or separately perform the heat treatment for removing the coating as described below because the antioxidant layer and the fixing layer can be easily removed.

Since the powder for a magnetic member has excellent moldability, the pressure of compacting can be decreased to a relatively low value, for example, 8 ton/cm$^2$ or more and 15 ton/cm$^2$ or less. Further, since the powder has excellent moldability, even a powder compact with a complicated shape can be easily formed. In addition, since the powder includes the magnetic particles each of which can be sufficiently deformed, it is possible to produce a powder compact having excellent bondability between the magnetic particles (development of strength (so-called necking strength) produced by engagement between surface projections and recesses of the magnetic particles) and high strength and being little breakable during production.

The powder for a magnetic member including the above-described antioxidant layer can sufficiently prevent oxidation of the newly formed surface formed on each of the magnetic particles, which constitute the powder, during compacting, and thus the molding can be performed in an oxygen-containing atmosphere such as an air atmosphere, improving workability. Also, the powder compact can be formed in the nonoxidizing atmosphere.

In addition, deformation can be accelerated by appropriately heating a mold during compacting, so that a powder compact having a high density can be easily produced.

[Magnetic Member and Method for Producing the Same]

The powder compact is heat-treated in an inert atmosphere or a reduced-pressure atmosphere to remove hydrogen from the hydrogen compound of the rare earth element and combine iron, the iron-boron alloy, and the rare earth element separated from hydrogen. Typically, this combination produces a rare earth-iron-boron-based alloy, thereby producing the magnetic member (magnetic member of the present invention) composed of the alloy as a main component. When the powder compact includes the magnetic particles each provided with the heat-resistant precursor layer, the heat treatment can separate the rare earth element from the rare earth source material constituting the heat-resistant precursor layer and diffuse the separated rare earth element in a surface layer portion of the each of the magnetic particles constituting the powder compact, thereby forming a rare earth-iron-boron composite material. The diffusion can form the heat-resistant coercive force layer composed of the rare earth-iron-boron composite material. That is, the magnetic member used as a raw material of a rare earth magnet is produced by heat-treating the powder compact in an inert atmosphere or a reduced-pressure atmosphere and includes the heat-resistant coercive force layer which is provided on the surface of each alloy particle constituting the magnetic member and which is composed of the rare earth-iron-boron composite material containing the rare earth element of the heat-resistant precursor layer and the constituent elements of the magnetic particles (a configuration of the magnetic member of the present invention).

The heat treatment (dehydrogenation) is performed in a nonhydrogen atmosphere in order to remove hydrogen from the hydrogen compound of the rare earth element. As described above, the nonhydrogen atmosphere is an inert atmosphere or a reduced-pressure atmosphere. The inert atmosphere is, for example, Ar or $N_2$. The reduced-pressure atmosphere represents a vacuum state under pressure lower than the standard atmospheric pressure, and the final vacuum degree is preferably 10 Pa of less. The reduced-pressure atmosphere is preferred because the rare earth-iron-boron alloy can be completely formed leaving little the hydrogen compound of a rare earth element, thereby producing a raw material (magnetic member) which can produce a magnetic body (typically a rare earth magnet) having excellent magnetic characteristics.

The temperature of the heat treatment (dehydrogenation) is equal to or higher than the recombination temperature (the temperature of combination of the separated iron-containing material and rare earth element) of the powder compact. The recombination temperature varies depending on the composition of the powder compact (the magnetic particles), but is typically 700° C. or more. The higher the temperature, the more sufficiently hydrogen can be removed. However, when the dehydrogenation temperature is excessively high, the rare earth element having a high vapor pressure may be decreased in amount by evaporation or the coercive force of a rare earth magnet may be decreased due to coarsening of rare earth-iron-boron-based alloy crystals. Therefore, the temperature is preferably 1000° C. or less. The retention time is, for example, 10 minutes or more and 600 minutes (10 hours) or less. The dehydrogenation corresponds to DR treatment of the HDDR treatment, and known DR treatment conditions can be applied.

When the antioxidant layer is composed of a material such as resin, which can be burned out at high temperature, the heat treatment (dehydrogenation) can also be performed for removing the antioxidant layer. In the heat treatment (dehydrogenation) of the powder compact including the magnetic particles each provided with the heat-resistant precursor layer, the heat treatment (dehydrogenation) is also performed for removing the fixing layer and forming the heat-resistant coercive force layer. The heat treatment (coating removal) for removing the antioxidant layer and the fixing layer may be performed separately. The heat treatment (coating removal) can be easily performed at a heating temperature of 200° C. or more and 400° C. or less for a retention time of 30 minutes or more and 300 minutes or less, depending on the constituent materials of the antioxidant layer and the fixing layer. The heat treatment (coating removal) is preferred for the case of the powder compact with a high density because in the heat treatment (dehydrogenation), incomplete combustion of the antioxidant layer and the fixing layer due to a rapid increase in temperature to the heating temperature can be effectively prevented, thereby preventing the occurrence of residue.

The alloy particles (internal composition) constituting the magnetic member of the present invention has a single form including substantially the phase of the rare earth-iron-boron-based alloy, or a mixed form including a combination of the rare earth-iron-boron-based alloy phase and at least one phase selected from the iron phase, the iron-boron alloy phase, and the rare earth-iron alloy phase. Examples of the mixed form include a form including the iron phase and the rare earth-iron-boron-based alloy phase, a form including the iron-boron alloy phase and the rare earth-iron-boron-based alloy phase, and a form including the rare earth-iron alloy phase and the rare earth-iron-boron-based alloy phase. An example of the single form is a form having substantially the same composition as the rare earth-iron-boron-based alloy used as a raw material for the powder for a magnetic member. The mixed form is typically changed depending on the composition of the rare earth-iron-boron-based alloy used as a raw material. For example, the form including the iron phase and the rare earth-iron-boron alloy phase can be formed by using a raw material having a high iron ratio (atomic ratio).

In the magnetic member produced by heat-treating (dehydrogenating) the powder compact composed of the magnetic particles each including the heat-resistant precursor layer, the composition of a surface layer portion of each of the alloy particles which constitute the magnetic member is composed of a composite material, for example, $(Dy, Nd)_2Fe_{14}B$, which contains the rare earth element such as Dy or Tb contained in the heat-resistant precursor layer as described above and the constituent elements (the rare earth element such as Y, Nd, Pr, or Ce, Fe, and B) of the magnetic particles. A region in which the composite material is present functions as the heat-resistant coercive force layer.

The thickness of the heat-resistant coercive force layer can be changed by adjusting the thickness of the coated film of the rare earth source material constituting the heat-resistant precursor layer, the size of the supply source particles, the amount of the supply source particles added, and the heat treatment conditions. The thickness of the heat-resistant coercive force layer is preferably 100 nm to 2000 nm because high coercive force can be sufficiently maintained even in a high-temperature environment.

By using the powder compact of the present invention, the degree of change in volume (amount of contraction after the heat treatment) before and after the heat treatment (dehydrogenation) is decreased, thereby causing little volume change as compared with production of a conventional sintered magnet. For example, the rate of volume change between the powder compact before the heat treatment (dehydrogenation) and the magnetic member after the heat treatment (dehydrogenation) is 5% or less. In this way, the magnetic member of the present invention causes a small volume change before and after the heat treatment (dehydrogenation), i.e., a net shape. Therefore, processing (for example, cutting or machining) for forming a final shape is not required, and thus productivity of the magnetic member is excellent. In addition, unlike in a sintered compact, grain boundaries of the powder can be observed in the magnetic member produced after the heat treatment (dehydrogenation). Therefore, the presence of grain boundaries of the powder is used as an index indicating that the powder compact is subjected to heat treatment and not a sintered compact, and the absence of marks of processing such as cutting can be used as an index indicating that the rate of volume change before and after heat treatment is small.

[Rare Earth Magnet]

A rare earth magnet can be produced by appropriately magnetizing the above-described magnetic member. In particular, by using the above-described powder compact having a high relative intensity, a rare earth magnet having a magnetic phase ratio of 80% by volume or more, still more 90% by volume or more, can be produced. Also, a decrease in magnetic phase ratio due to oxides can be suppressed by using the powder for a magnetic member of the present invention, and from this viewpoint, a rare earth magnet having a high magnetic phase ratio can be produced. Further, when the powder for a magnetic member provided with the heat-resistant precursor layer is used, a rare earth magnet capable of maintaining high coercive force even in a high-temperature environment can be produced.

Figure 2:
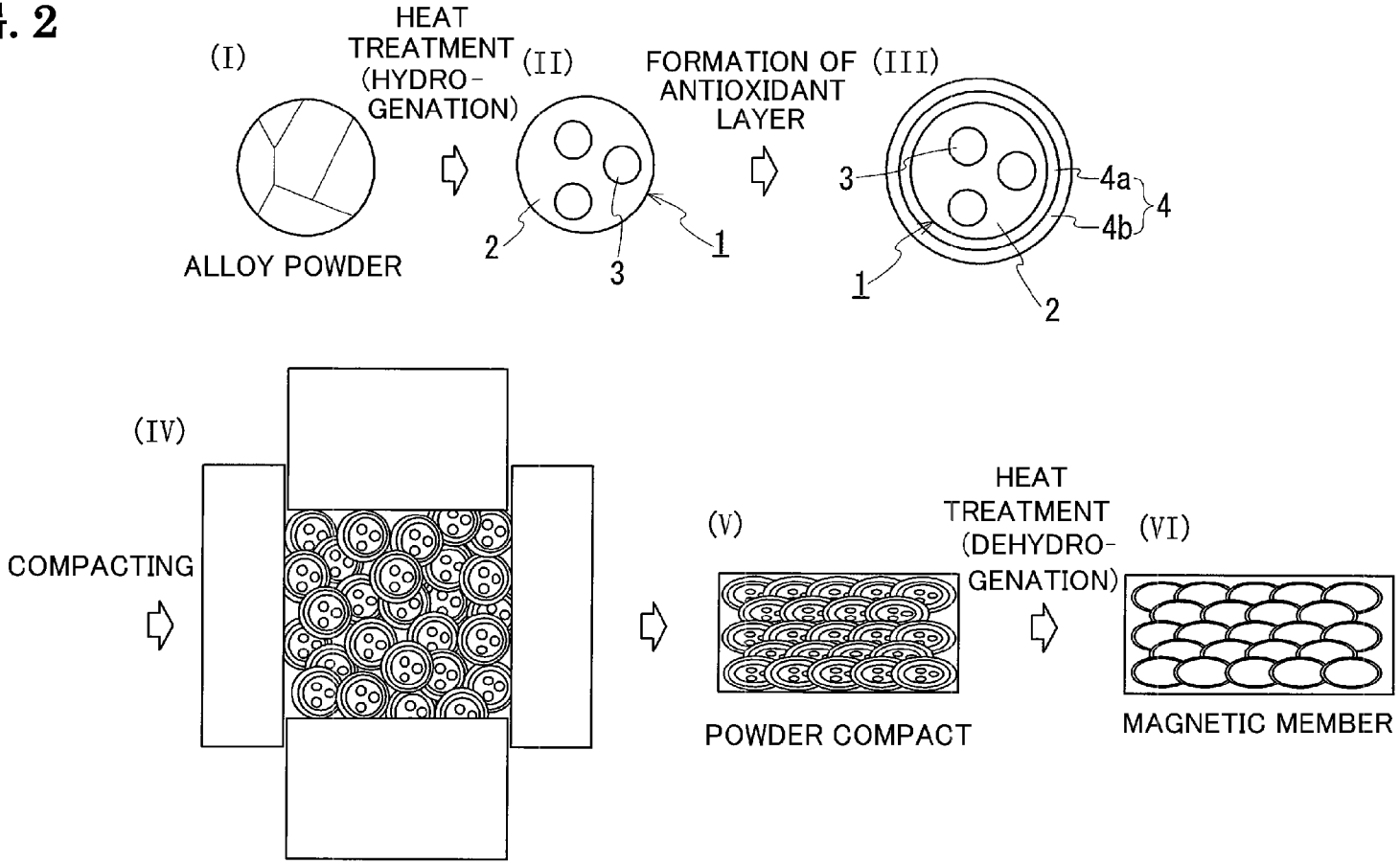
FIG. 2 is an explanatory process drawing illustrating an example of a process for producing a magnetic member using a powder for a magnetic member according to Embodiment 2 of the present invention.
Figure 3:
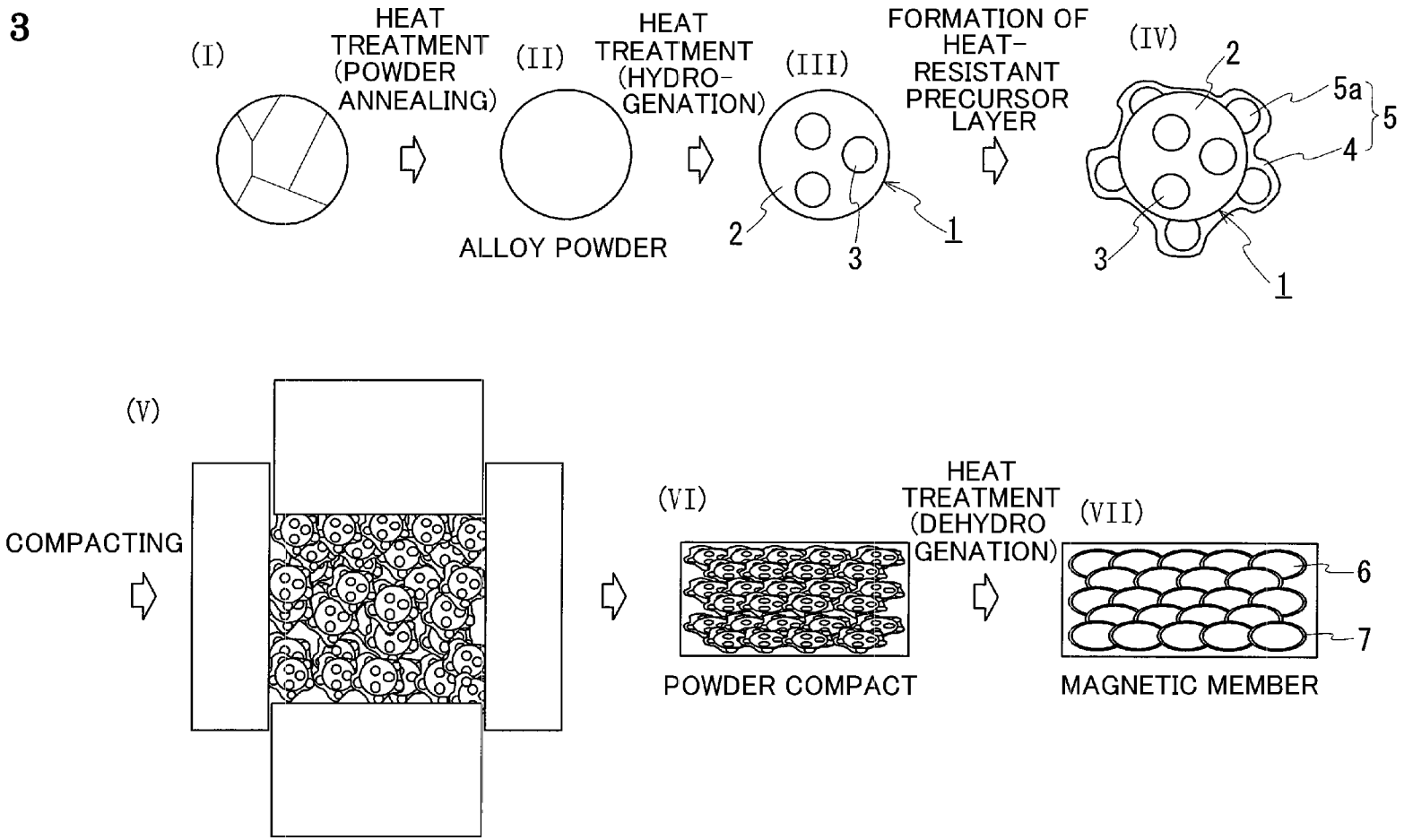
FIG. 3 is an explanatory process drawing illustrating an example of a process for producing a magnetic member using a powder for a magnetic member according to Embodiment 3 of the present invention.

Embodiments of the present invention are described in further detail below with reference to the drawings. In the drawings, the same reference numeral denotes the same substance. In FIGS. 1 to 3, a hydrogen compound of a rare earth element, an antioxidant layer, and a heat-resistant precursor layer are exaggerated to be easy to understand.

EMBODIMENT 1

A powder containing a rare earth element, iron, and boron was prepared, and the resultant powder was compression-molded to examine moldability and an oxidation state of the powder.

The powder was prepared according to the procedures including a preparation step of preparing an alloy powder, a hydrogenation step of heat treatment in a hydrogen atmosphere, and a coating step of forming an antioxidant layer.

First, a powder (FIG. 1(I)) composed of a rare earth-iron-boron alloy ($Nd_2Fe_{14}B$) and having an average particle diameter of 100 μm was prepared by a gas atomization method (Ar atmosphere). The average particle diameter was measured as a particle diameter (particle diameter at 50%) at 50% of accumulated weight percentage using a laser diffraction-type particle size distribution analyzer. In addition, the alloy powder including particles composed of a polycrystal was prepared by the gas atomization method.

The alloy powder was heat-treated in a hydrogen ($H_2$) atmosphere at 800° C. for 1 hour. Then, the antioxidant layer composed of a polyamide resin (here, nylon 6, oxygen permeability coefficient (30° C.): $0.0011\times10^{-11}$ $m^3\cdot m/(s\cdot m^2\cdot Pa)$ was formed in the base powder produced after the heat treatment (hydrogenation). Specifically, the base powder was mixed with the polyamide resin dissolved in an alcohol solvent, and then the antioxidant layer was formed by removing the solvent and curing the resin. The amount of the resin was adjusted so that the thickness of the antioxidant layer was 200 nm. The thickness was the average thickness (volume of the resin/total surface area of the magnetic particles) on the assumption that the antioxidant layer was uniformly formed on the surface of each of the magnetic particles constituting the base powder. The surface area of the magnetic particles can be measured by, for example, a BET method. In this step, the powder for a magnetic member composed of the particles each including the antioxidant layer which is provided on the periphery of each magnetic particle and which has an oxygen permeability coefficient (30° C.) of less than $1.0\times10^{-11}$ $m^3\cdot m/(s\cdot m^2\cdot Pa)$ can be produced.

The resultant powder for a magnetic member was fixed with an epoxy resin to prepare a sample for structure observation. The sample was cut or polished at a desired position so as to prevent oxidation of the powder contained in the sample, and the composition of each of the particles constituting the powder for a magnetic member and present in the cut surface (or the polished surface) was measured using an energy-dispersive X-ray diffraction (EDX) apparatus. In addition, the cut surface (or the polished surface) was observed with an optical microscope or a scattering electron microscope SEM (100 times to 10,000 times) to examine the form of each of the magnetic particles. As a result, it was confirmed that as shown in FIG. 1(II) and FIG. 1(III), each of the magnetic particles includes a phase of an iron-containing material 2, specifically a phase of iron (Fe) and an iron-boron alloy ($Fe_3B$)) serving as a mother phase, and a plurality of granular phases of a hydrogen compound ($NdH_2$)3 of a rare earth element, which are dispersed in the mother phase, and the phase of the iron-containing material 2 is interposed between the adjacent particles of the hydrogen compound 3 of a rare earth element. It was also confirmed that as shown in FIG. 1(III), substantially the entire surface of each of the magnetic particles 1 is covered with the antioxidant layer 4 and cut off from the outside air. Further, an oxide of a rare earth element (in this case, $Nd_2O_3$) was not detected in the magnetic particles 1.

As a result of measurement of the distance between the adjacent particles of the hydrogen compound of the rare earth element by surface analysis (mapping data) of the composition of the powder for a magnetic member using the EDX apparatus, the distance was 0.6 μm. In this case, peak positions of $NdH_2$ were extracted in the surface analysis of the cut surface, and the distances between the adjacent $NdH_2$ peak positions were measured and averaged to determine an average value.

The contents (% by volume) of $NdH_2$ and the iron-containing material (Fe, Fe—B) of each of the magnetic particles were determined using the sample formed by combining with the epoxy resin. As a result, the $NdH_2$ content was 33% by volume, and the content of the iron-containing material was 67% by volume. The contents were each determined by calculating a volume ratio using the composition of the alloy powder used as a raw material and the atomic weights of $NdH_2$, Fe, and $Fe_3B$. Alternatively, each of the contents can be determined by, for example, calculating a volume ratio from an area ratio determined by the area ratios of $NdH_2$, Fe, and $Fe_3B$ in the area of the cut surface (or the polished surface) of the molded product produced using the base powder, or by using a peak intensity ratio according to X-ray analysis.

The circularity of the magnetic particles was determined using the sample formed by combining with the epoxy resin. As a result, the circularity was 0.86. In this case, the circularity was determined as follows. A projection image of a section of the powder was obtained by the optical microscope or SEM, and the actual sectional area Sr and the actual boundary length of each particle were determined. The ratio Sr/Sc of the actual sectional area Sr to the area Sc of a perfect circle having the same boundary length as the actual boundary length was determined as the circularity of the particle. Sampling with n=50 was performed, and the average value of circularity of the particles with n=50 was regarded as the circularity of the magnetic particles.

The powder for a magnetic member including the antioxidant layer produced as described above was compression-molded with a hydraulic press under a surface pressure of 10 ton/cm$^2$ (FIG. 1(IV)). In this case, the molding was performed in an air atmosphere (air temperature: 25° C., humidity: 40%). As a result, the powder could be sufficiently compressed under the surface pressure of 10 ton/cm$^2$ to form a columnar powder compact (FIG. 1(V)) having an outer diameter of 10 mm and a height of 10 mm.

As a result of determination of the relative density (actual density relative to the true density) of the resultant powder compact, the relative density was 93%. The actual density was measured by using a commercial density measuring apparatus. The true density was determined by calculation using the density of $NdH_2$ of 5.96 g/cm$^3$, the density of Fe of 7.874 g/cm$^3$, the density of $Fe_3B$ of 7.474 g/cm$^3$, and the volume ratios of $NdH_2$ and the iron-containing material described above. In addition, as a result of X-ray analysis of the resultant powder compact, a clear diffraction peak of an oxide of a rare earth element (in this case, $Nd_2O_3$) was not detected.

As described above, it is found that by using the powder including less than 40% by volume of the hydrogen compound of a rare earth element and the balance substantially composed of the iron-containing material containing Fe and $Fe_3B$, the hydrogen compound of a rare earth element being dispersed in the phase of the iron-containing material, a powder compact having a complicated shape such as a cylindrical shape or a high-density powder compact having a high relative density of 85% or more can be produced. Also, it is found that by using the powder including the antioxidant layer, a powder compact containing substantially no oxide of a rare earth element due to the suppression of formation of the oxide can be produced.

The resultant powder compact was maintained in a nitrogen atmosphere at 300° C. for 120 minutes and then heated to 750° C. in a hydrogen atmosphere, and then the atmosphere was changed to vacuum (VAC) (final vacuum degree: 1.0 Pa) in which the powder compact was heat-treated (dehydrated) at 750° C. for 60 minutes. Since heating was performed in the hydrogen atmosphere, dehydrogenation reaction can be started after the temperature becomes sufficiently high, thereby suppressing reaction spots. The composition of the cylindrical member (magnetic member (FIG. 1(VI))) produced after the heat treatment was examined by the EDX apparatus. As a result, it was found that a main phase (87% by volume or more) is composed of $Nd_2Fe_{14}B$, and hydrogen is removed by the heat treatment.

In addition, as a result of X-ray analysis of the cylindrical member, clear diffraction peaks of an oxide of a rare earth element (in this case, $Nd_2O_3$) and the residue of the antioxidant layer were not detected. Therefore, it is found that by using the powder for a magnetic member including the antioxidant layer, the formation of an oxide of a rare earth element such as $Nd_2O_3$ which induces a decrease in coercive force can be suppressed. Further, in Embodiment 1, the antioxidant layer is made of a resin, and thus the layer can sufficiently follow deformation of each of the magnetic particles constituting the powder during the compacting, thereby exhibiting excellent moldability.

Further, comparing the volume of the powder compact before the heat treatment (dehydrogenation) with the volume of the cylindrical member (magnetic member) produced after the heat treatment (dehydrogenation), the rate of volume change before and after the heat treatment was 5% or less. Therefore, when the magnetic member is used as a raw material for a rare earth magnet, separate processing such as cutting for forming a desired outer shape is not required, and thus contribution to improvement in productivity of the rare earth magnet is expected.

EMBODIMENT 2

A material powder for a magnetic member including an antioxidant layer having a configuration different from that in Embodiment 1 was prepared to examine moldability and an oxidation state of the powder.

In Embodiment 2, the same powder for a magnetic member as prepared in Embodiment 1, which included the magnetic particles with the peripheries each coated with the polyamide resin (nylon 6), was prepared, and the surface of the powder was further coated with polyethylene (moisture permeability coefficient (30° C.): $50\times10^{-13}$ kg/(m·s·MPa)). Specifically, the powder including the coating of the polyamide resin was mixed with polyethylene dissolved in xylene as a solvent, followed by removal of the solvent and curing the polyethylene. In this case, the amount of polyethylene was adjusted so that the average thickness of the coating composed of polyethylene was 250 nm. The thickness was the average thickness (volume of polyethylene/total surface area of the magnetic particles) on the assumption that the polyethylene layer was uniformly formed on the surface of each of the magnetic particles constituting the prepared powder. The surface area of the particles can be measured by, for example, a BET method. In this step, the powder for a magnetic member can be produced, in which the particles constituting the powder each include a multilayer-structure antioxidant layer (average total thickness: 450 nm) provided on the periphery of each magnetic particle, the antioxidant layer including a laminate of a low-oxygen permeable layer which was composed of the polyamide resin having an oxygen permeability coefficient (30° C.) of less than $1.0\times10^{-11}$ m$^3$·m/(s·m$^2$·Pa) and a low-moisture permeable layer which was composed of polyethylene having a moisture permeability coefficient (30° C.) of less than $1000\times10^{-13}$ kg/(m·s·MPa).

A sample for structure observation of the resultant powder for a magnetic member was formed by the same method as in Embodiment 1, and the composition of the magnetic particles constituting the powder was examined. As a result, like in Embodiment 1, three phases of Fe, $Fe_3B$, and $NdH_2$ were detected. Also, it was confirmed that as shown in FIG. 2(II) and FIG. 2(III), each of the magnetic particles includes a phase of an iron-containing material 2 containing Fe and $Fe_3B$ serving as a mother phase, and a plurality of granular phases of a hydrogen compound ($NdH_2$) 3 of a rare earth element, which are dispersed in the mother phase. It was also confirmed that as shown in FIG. 2(III), the surface of each of the magnetic particles 1 is covered with the multilayer antioxidant layer 4 including in order a low-oxygen permeable layer 4*a* composed of a polyamide resin and a low-moisture permeable layer 4*b* composed of polyethylene. Further, an oxide of a rare earth element (in this case, $Nd_2O_3$) was not detected in the magnetic particles 1. Like in Embodiment 1, the measurement of the distance between the adjacent $NdH_2$ particles showed a distance of 0.6 μM, and determination of the contents (% by volume) of $NdH_2$ and the iron-containing material (Fe, Fe—B) of each of the magnetic particles showed a $NdH_2$ content of 32% by volume and a content of the iron-containing material of 68% by volume.

The powder for a magnetic member including the multilayer-structure antioxidant layer produced as described above was compression-molded with a hydraulic press under a surface pressure of 10 ton/cm$^2$ (FIG. 2(IV)). In this case, the molding was performed in the air atmosphere (air temperature: 25° C., humidity: 75% (much moisture)). As a result, the powder could be sufficiently compressed under the surface pressure of 10 ton/cm$^2$ to form a columnar powder compact (FIG. 2(V)) having an outer diameter of 10 mm and a height of 10 mm. As a result of determination of the relative density of the resultant powder compact by the same method as in Embodiment 1, the relative density was 91%.

Further, the resultant powder compact was heat-treated (dehydrogenated) under the same conditions as in Embodiment 1, and the composition of the resultant cylindrical member (magnetic member (FIG. 2(VI))) was examined by the EDX apparatus. As a result, it was found that a main phase (89% by volume or more) is composed of $Nd_2Fe_{14}B$, and hydrogen is removed by the heat treatment. In addition, as a result of X-ray analysis of the resultant cylindrical member, clear diffraction peaks of an oxide of a rare earth element (in this case, $Nd_2O_3$) and the residue of the antioxidant layer were not detected. Also in the magnetic member of Embodiment 2, the rate of volume change before and after the heat treatment (dehydrogenation) was 5% or less.

As described above, it is found that by using the powder for a magnetic member including the antioxidant layer, the formation of an oxide of a rare earth element such as $Nd_2O_3$ which induces a decrease in coercive force can be suppressed. In particular, it is found that even in the case of compacting under a high-humidity condition in which a relatively large amount of moisture is present, the formation of an oxide of a rare earth element can be effectively suppressed. In addition, in Embodiment 2, both the low-oxygen permeable layer and the low-moisture permeable layer are made of resins, and thus both layers can sufficiently follow deformation of each of the magnetic particles constituting the powder during the compacting, thereby exhibiting excellent moldability and excellent adhesion between both layers.

Test Example 1

Each of the magnetic members produced in Embodiments 1 and 2 and composed of a rare earth-iron-boron alloy was magnetized by a pulsed magnetic field of 2.4 MA/m (=30 kOe), and then the magnet characteristics of each of the samples produced (rare earth-iron-boron-based alloy magnet) were examined using a BH tracer (DCBH tracer manufactured by Riken Denshi Co., Ltd.). The results are shown in Table I. In this case, as the magnetic characteristics, saturation magnetic flux density Bs (T), residual magnetic flux density Br (T), intrinsic coercive force iHc, and the maximum product (BH)max of magnetic flux density B and magnitude H of demagnetizing field were determined (all values at room temperature (20° C.)).

TABLE I

| Embodiment | Phase appearing during dehydrogenation | Molding density (relative) % by volume | Hydrogen compound distance μm | Magnet characteristics Bs T | Br T | iHc kA/m | (BH) max kJ/m$^3$ |
|---|---|---|---|---|---|---|---|
| 1 | $Nd_2Fe_{14}B$ | 93 | 0.6 | 1.37 | 0.69 | 630 | 141 |
| 2 | $Nd_2Fe_{14}B$ | 91 | 0.6 | 1.41 | 0.73 | 852 | 158 |

Table I indicates that a rare earth magnet produced using a powder containing less than 40% by volume of a hydrogen compound of a rare earth element and the balance substantially composed of an iron-containing material, the hydrogen compound of rare earth element being disposed in the phase of the iron-containing material, has excellent magnetic characteristics. In particular, it is found that a rare earth magnet having a high magnetic phase ratio and excellent magnet characteristics can be produced, without sintering, by using a powder compact having a relative density of 85% or more. It is also found that a rare earth magnet having a high magnetic phase ratio and excellent magnet characteristics can be produced by using a powder including an antioxidant layer because a decrease in magnetic phase ratio due to the intervention of an oxide is suppressed.

EMBODIMENT 3

A powder containing a rare earth element, iron, and boron was prepared, and the resultant powder was compression-molded to examine moldability of the powder. In this embodiment, a powder including a heat-resistant precursor layer was prepared.

The powder was prepared according to the procedures including a preparation step of preparing an alloy powder, a hydrogenation step of heat treatment in a hydrogen atmosphere, and a coating step of forming a heat-resistant precursor layer.

First, a powder (FIG. 3(I)) composed of a rare earth-iron-boron alloy ($Nd_2Fe_{14}B$) and having an average particle diameter of 100 μm was prepared by a gas atomization method (Ar atmosphere). The average particle diameter was measured by the same method as in Embodiment 1. In addition, the alloy powder including particles each composed of a polycrystal was prepared by the gas atomization method. The powder was heat-treated (powder annealing: 1050° C. for 120 minutes, in high-concentration argon) to prepare an alloy powder composed of a single crystal (FIG. 3(II)).

The alloy powder was heat-treated in a hydrogen ($H_2$) atmosphere at 800° C. for 1 hour. Then, the heat-resistant precursor layer was formed on the base powder produced after the heat treatment (hydrogenation), the heat-resistant precursor layer including Dy hydride ($DyH_2$) or a binary alloy of Dy and Ni (Dy-30 atomic % Ni) and a fixing layer composed of a polyamide resin (here, nylon 6, oxygen permeability coefficient (30° C.): $0.0011\times10^{-11}$ m$^3$·m/(s·m$^2$·Pa)). Specifically, commercial $DyH_2$ powder having an average particle diameter of 1 μm or commercial DyNi powder having an average particle diameter of 1 μm was prepared and the $DyH_2$ powder or the DyNi powder was mixed with the polyamide resin dissolved in an organic solvent to prepare a mixture. The resultant mixture was further mixed with the base powder, and then the solvent was dried and the resin was cured, forming a powder (Embodiment 3-1) including the heat-resistant precursor layer containing $DyH_2$ or a powder (Embodiment 3-2) including the heat-resistant precursor layer containing DyNi. In both Embodiments 3-1 and 3-2, the resin amount was adjusted so that the average thickness of a resin component of the heat-resistant precursor layer was 200 nm. The thickness of the fixing layer composed of the resin was an average thickness (volume of the resin/total surface area of the magnetic particles) on the assumption that the fixing layer was uniformly formed on the surface of each of the magnetic particles constituting the base powder. In addition, the $DyH_2$ powder or the DyNi powder has a state where supply source particles constituting the powder are partially fixed to the base powder with the resin component, and the size of the particles is excluded from the thickness of the fixing layer. The surface area of the magnetic particles can be measured by, for example, a BET method. In this step, the powder for a magnetic member can be produced, in which the particles constituting the magnetic member each include granular $DyH_2$ or DyNi which is fixed to the periphery of each magnetic particle with the fixing layer composed of the resin having an oxygen permeability coefficient (30° C.) of less than $1.0\times10^{-11}$ $m^3\cdot m/(s\cdot m^2\cdot Pa)$.

In this test, the resultant powder and polyethylene (moisture permeability coefficient (30° C.): $50\times10^{-13}$ kg/(m·s·MPa) powder were heated to 150° C. under mixing, and then directly cooled to produce the powder coated with the polyethylene. The raised temperature was equal to or higher than the melting point of polyethylene and equal to or lower than the melting point of nylon 6. In this step, the powder for a magnetic member including the heat-resistant precursor layer can be produced, the heat-resistant precursor layer containing the rare earth source material (supply source particles) and the fixing layer which fixes the particles. The fixing layer had a multilayer structure including a low-oxygen permeable layer and a low-moisture permeable layer and functioned as the antioxidant layer.

The resultant powder for a magnetic member was fixed with an epoxy resin to prepare a sample for structure observation. A cut surface (or a polished surface) of the sample was formed by the same method as in Embodiment 1, and the composition of each of the particles constituting the powder for a magnetic member was measured using an energy-dispersive X-ray diffraction (EDX) apparatus. In addition, the form of each of the magnetic particles was observed with an optical microscope or a scanning electron microscope SEM (100 times to 10,000 times). As a result, it was confirmed that as shown in FIG. 3(III) and FIG. 3(IV), each of the magnetic particles includes a phase of an iron-containing material 2, specifically a phase of iron (Fe) and an iron-boron alloy ($Fe_3B$)) serving as a mother phase, and a plurality of granular phases of a hydrogen compound ($NdH_2$) 3 of a rare earth element, which are dispersed in the mother phase, and the phase of the iron-containing material 2 is interposed between the adjacent particles of the hydrogen compound 3 of a rare earth element. It was also confirmed that as shown in FIG. 3(IV), the heat-resistant precursor layer 5 including the granular rare earth source material (in this case, $DyH_2$ or DyNi) 5*a* fixed with the fixing layer 4 is provided on the surface of each of the magnetic particles 1. It was further confirmed that substantially the entire surface of each of the magnetic particles 1 is covered with the fixing layer 4 composed of the resin and cut off from the outside air. Further, an oxide of a rare earth element (in this case, $Nd_2O_3$) was not detected in the magnetic particles 1.

As a result of measurement of the distance between the adjacent particles of the hydrogen compound of the rare earth element by surface analysis (mapping data) of the composition of the powder for a magnetic member using the EDX apparatus in the same manner as in Embodiment 1, the distance was 0.6 μm.

The contents (% by volume) of $NdH_2$ and the iron-containing material (Fe, Fe—B) of each of the magnetic particles were determined using the sample formed by combining with the epoxy resin in the same manner as in Embodiment 1. As a result, the $NdH_2$ content was 33% by volume, and the content of the iron-containing material was 67% by volume.

The circularity of the magnetic particles was determined using the sample formed by combining with the epoxy resin in the same manner as in Embodiment 1. As a result, the circularity was 0.86.

The powder for a magnetic member including the heat-resistant precursor layer produced as described above was compression-molded with a hydraulic press under a surface pressure of 10 ton/$cm^2$ (FIG. 3(V)). In this case, the molding was performed in an air atmosphere (air temperature: 25° C., humidity: 75%). As a result, the powder could be sufficiently compressed under the surface pressure of 10 ton/$cm^2$ to form a cylindrical powder compact (FIG. 3(VI)) having an outer diameter of 10 mm and a height of 10 mm.

As a result of determination of the relative density (actual density relative to the true density) of the resultant powder compact in the same manner as in Embodiment 1, the relative density was 90%. In addition, as a result of X-ray analysis of the resultant powder compact, a clear diffraction peak of an oxide of a rare earth element (in this case, $Nd_2O_3$) was not detected.

As described above, it is found that by using the powder including less than 40% by volume of the hydrogen compound of a rare earth element and the balance substantially composed of the iron-containing material containing Fe and $Fe_3B$, the hydrogen compound of a rare earth element being dispersed in the phase of the iron-containing material, a powder compact having a complicated shape such as a cylindrical shape or a high-density powder compact having a high relative density of 85% or more can be produced. It is also found that by using the resin as the constituent component of the heat-resistant precursor layer, the resin can sufficiently follow deformation of each of the magnetic particles constituting the power for a magnetic member and thus the powder has excellent moldability. Further it is found that by using the powder including the magnetic particles with the surfaces covered with the resin having the antioxidant effect, a powder compact containing substantially no oxide of a rare earth element due to the suppression of formation of the oxide can be produced.

The resultant powder compact was maintained in a nitrogen atmosphere at 300° C. for 120 minutes and then heated to 750° C. in a hydrogen atmosphere, and then the atmosphere was changed to vacuum (VAC) (final vacuum degree: 1.0 Pa) in which the powder compact was heat-treated (dehydrated) at 750° C. for 60 minutes. Since heating was performed in the hydrogen atmosphere, reaction spots can be suppressed as described above. The composition of the cylindrical member (magnetic member (FIG. 3(VII))) produced after the heat treatment was examined by the EDX apparatus. As a result, it was found that a main phase (87% by volume or more) is composed of $Nd_2Fe_{14}B$, and hydrogen is removed by the heat treatment. Also, it was confirmed that the cylindrical member includes alloy particles 6 composed of the $Nd_2Fe_{14}B$, and a $(Dy, Nd)_2Fe_{14}B$ component is present in a surface layer portion of each of the alloy particles 6. The $(Dy, Nd)_2Fe_{14}B$ component can be confirmed by observing a crystal structure through XRD or surface analysis using the EDX apparatus or line analysis. The presence of the $(Dy, Nd)_2Fe_{14}B$ component in a surface layer portion of each of the alloy particles 6 indicates that the $DyH_2$ or DyNi constituting the heat-resistant precursor layer is decomposed by the heat treatment (dehydrogenation), and the Dy component diffuses into the magnetic particles constituting the powder compact to form a heat-resistant coercive force layer 17 including a composite material composed of the rare earth element (Dy) of the heat-resistant precursor layer 5 and the constituent elements (Nd, Fe, B) of the magnetic particles 1.

In addition, as a result of X-ray analysis of the cylindrical member, clear diffraction peaks of an oxide of a rare earth element (in this case, $Nd_2O_3$) and the residue of the resin component of the heat-resistant precursor layer were not detected.

As described above, it is found that by using the powder for a magnetic member including the heat-resistant precursor layer containing the specified rare earth element, a magnetic member including the heat-resistant coercive force layer composed of the rare earth-iron-boron composite material can be produced. In addition, a rare earth magnet produced using as a raw material the magnetic member having the heat-resistant coercive force layer is expected to have high coercive force even in a high-temperature atmosphere.

Also, it is found that since the powder for a magnetic member includes the heat-resistant precursor layer including as the constituent component the resin having the anti-oxidant effect, the formation of an oxide of a rare earth element such as $Nd_2O_3$ which induces a decrease in coercive force can be suppressed. In particular, it is considered that in this embodiment, both the low-oxygen permeable layer and the low-moisture permeable layer are provided, and thus the newly formed surface of each of the magnetic particles constituting the powder for a magnetic member during the compacting can be prevented from being oxidized by contact with moisture in the atmosphere even in the high-humidity atmosphere of compacting, and formation of an oxide of the rare earth element can be suppressed. From this viewpoint, it is expected that a rare earth magnet having high coercive force can be produced.

Further, comparing the volume of the powder compact before the heat treatment (dehydrogenation) with the volume of the cylindrical member (magnetic member) produced after the heat treatment (dehydrogenation), the rate of volume change before and after the heat treatment was 5% or less. Therefore, when the magnetic member is used as a raw material for a rare earth magnet, separate processing such as cutting for forming a desired outer shape is not required, and thus contribution to improvement in productivity of the rare earth magnet is expected.

Test Example 2

Each of the magnetic members produced using the powders for a magnetic member of Embodiments 3-1 and 3-2 and composed of a rare earth-iron-boron alloy was magnetized by a pulsed magnetic field of 2.4 MA/m (=30 kOe), and then the magnet characteristics of each of the samples produced (rare earth-iron-boron alloy magnet) were examined using a BH tracer (DCBH tracer manufactured by Riken Denshi Co., Ltd.). The results are shown in Table II. In this case, the magnet characteristics at room temperature RT (about 20° C.), such as saturation magnetic flux density Bs (T), residual magnetic flux density Br (T), intrinsic coercive force iHc (kA/m), and the maximum product (BH)max (kJ/m$^3$) of magnetic flux density B and magnitude H of demagnetizing field, and Bs (T), Br (T), iHc (kA/m), and (BH)max (kJ/m$^3$) at 100° C. were determined. As a comparison, these magnet characteristics at RT and 100° C. of the sample of Embodiment 2 were also measured. The results are shown in Table II.

TABLE II

| Sample No. | Heat-resistant precursor layer | Molding density (relative) % by volume | Magnet characteristics (RT/100° C.) Bs T | Br T | iHc kA/m | (BH) max kJ/m$^3$ |
|---|---|---|---|---|---|---|
| Embodiment 3-1 | $DyH_2$/nylon 6 + polyethylene | 90 | 1.36/1.31 | 0.68/0.61 | 937/521 | 147/110 |
| Embodiment 3-2 | DyNi/nylon 6 + polyethylene | 89 | 1.33/1.29 | 0.68/0.63 | 960/552 | 140/121 |
| Embodiment 2 | nylon 6 + polyethylene | 91 | 1.41/1.38 | 0.73/0.65 | 852/336 | 158/84 |

Table II indicates that a rare earth magnet produced using a powder including magnetic particles each of which contains less than 40% by volume of a hydrogen compound of a rare earth element and the balance substantially composed of an iron-containing material, and each of which has a specified heat-resistant precursor layer provided on the surface, the hydrogen compound of rare earth element being disposed in the phase of the iron-containing material, has high coercive force even in a high-temperature environment and excellent magnet characteristics.

Modified Example

In Embodiment 3, a configuration is described, in which a resin having a low-oxygen permeability coefficient is used for the resin layer provided in the heat-resistant precursor layer on the surface of the magnetic member, and a low-moisture permeable layer composed of a resin having a low moisture permeability coefficient is further provided on the low-oxygen permeable layer. However, the resin layer provided in the heat-resistant precursor layer may include only the low-oxygen permeable layer.

In addition, the present invention is not limited to the above-described embodiments, and appropriate changes can be made without deviating from the gist of the present invention. For example, the composition (constituent elements, atomic ratios, ratios of the hydrogen compound of a rare earth element and the iron-containing material, etc.) and circularity of the magnetic particles, the average particle diameter of the powder for a magnetic member, the material, thickness, and the oxygen permeability coefficient and moisture permeability coefficient of the anti-oxidant layer, the relative density of the powder compact, various heat treatment conditions (heating temperature and retention time), and the composition of the rare earth-iron-boron-based alloy used as the raw material, etc. can be appropriately changed. In addition, the form (e.g., coated film) of the heat-resistant precursor layer, the material (constituent elements of a compound or an alloy, the type of the resin, etc.) of the heat-resistant precursor layer, the average particle diameter of the rare earth source material constituting the heat-resistant precursor layer, the material, thickness, oxygen permeability coefficient, and moisture permeability coefficient of the fixing layer constituting the heat-resistant precursor layer, etc. can be appropriately changed.

INDUSTRIAL APPLICABILITY

A powder for a magnetic member of the present invention and a powder compact and a magnetic member which are produced from the powder can be preferably used as raw materials for permanent magnets used for various motors, particularly high-speed motors provided in a hybrid electric vehicle (HEV) and a hard disk drive (HDD).

REFERENCE SIGNS LIST

1 magnetic particle
2 iron-containing material
3 hydrogen compound of rare earth element
4 antioxidant layer (fixing layer)
4*a* low-oxygen permeable layer
4*b* low-moisture permeable layer
5 heat-resistant precursor layer
5*a* granular rare earth source material
6 alloy particle
7 heat-resistant coercive force layer

The invention claimed is:

1. A powder for a magnetic member used for a raw material, the powder comprising:

magnetic particles which constitute the powder for a magnetic member, wherein:

each of the magnetic particles is composed of less than 40% by volume of a hydrogen compound of a rare earth element, and the balance composed of an iron-containing material, the iron-containing material contains iron and an iron-boron alloy containing iron and boron, the hydrogen compound of a rare earth element is dispersed in a phase of the iron-containing material, an antioxidant layer having an oxygen permeability coefficient (30° C.) of less than $1.0\times10^{-11}$ $m^3\cdot m/(s\cdot m^2\cdot Pa)$ is provided on the periphery of each of the magnetic particles, the antioxidant layer is composed of a resin, the rare earth element is at least one selected from the group consisting of Nd, Pr, Ce, and Y, a heat-resistant precursor layer is provided on the surface of each of the magnetic particles, and the heat-resistant precursor layer includes a rare earth source material composed of at least one of a compound and an alloy which contains at least one rare earth element of Dy and Tb and does not contain oxygen, and the antioxidant layer which covers at least a portion of the rare earth source material.

2. The powder for a magnetic member according to claim 1, wherein the antioxidant layer has a moisture permeability coefficient (30° C.) of less than $1000\times10^{-13}$ kg/(m·s·MPa).

3. The powder for a magnetic member according to claim 1, wherein the antioxidant layer includes a low-oxygen permeable layer composed of a material having an oxygen permeability coefficient (30° C.) of less than $1.0\times10^{-11}$ $m^3\cdot m/(s\cdot m^2\cdot Pa)$ and a low-moisture permeable layer composed of a material having a moisture permeability coefficient (30° C.) of less than $1000\times10^{-13}$ kg/(m·s·MPa).

4. The powder for a magnetic member according to claim 3, wherein the magnetic particles have a circularity of 0.5 or more and 1.0 or less.

5. The powder for a magnetic member according to claim 1, wherein the thickness of the antioxidant layer is 10 nm or more and 1000 nm or less.

6. The powder for a magnetic member according to claim 1, wherein the antioxidant layer includes a low-oxygen permeable layer composed of one selected from a polyamide resin, polyester, and polyvinyl chloride which have an oxygen permeability coefficient (30° C.) of less than $1.0\times10^{-11}$ $m^3\cdot m/(s\cdot m^2\cdot Pa)$.

7. The powder for a magnetic member according to claim 1, wherein the rare earth source material is at least one selected from the group consisting of hydrides, iodides, fluorides, chlorides, bromides, intermetallic compounds, and alloys thereof.

8. The powder for a magnetic member according to claim 1, wherein the rare earth source material is granular, and particles of the source material are fixed to the surface of each of the magnetic particles through the antioxidant layer.

9. The powder for a magnetic member according to claim 1, wherein the rare earth element is at least one selected from the group consisting of Nd, Pr, Ce, Dy, and Y.

10. The powder for magnetic member according to claim 1, wherein the hydrogen compound of the rate earth element consists of a rare earth element and hydrogen.

11. The powder for magnetic member according to claim 1, wherein the hydrogen compound of the rare earth element is at least one selected from $NdH_2$ or $DyH_2$.

12. A powder compact used for a raw material of a magnetic member, wherein the powder compact is produced by compacting the powder for a magnetic member according to claim 1.

13. The powder compact according to claim 12, wherein the relative density of the powder compact is 85% or more.

14. A magnetic member produced by heat-treating the powder compact according to claim 12 in an inert atmosphere or a reduced-pressure atmosphere.

15. The magnetic member according to claim 14, wherein a rate of volume change between the powder compact before the heat treatment and the magnetic member after the heat treatment is 5% or less.

* * * * *